US008059145B2

(12) United States Patent
Ueda et al.

(10) Patent No.: US 8,059,145 B2
(45) Date of Patent: Nov. 15, 2011

(54) COLOR IMAGE FORMING APPARATUS AND IMAGE FORMING METHOD

(75) Inventors: Tadayuki Ueda, Tokyo (JP); Ryuji Okutomi, Tokyo (JP); Hiroyuki Watanabe, Tokyo (JP); Akifumi Isobe, Tokyo (JP); Yoshihito Sasamoto, Tokyo (JP); Takashi Nara, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 974 days.

(21) Appl. No.: 12/015,166

(22) Filed: Jan. 16, 2008

(65) Prior Publication Data

US 2008/0174834 A1 Jul. 24, 2008

(30) Foreign Application Priority Data

Jan. 22, 2007 (JP) ..... 2007-011719

(51) Int. Cl.
*B41J 2/44* (2006.01)
*G03G 15/01* (2006.01)
*G03G 13/01* (2006.01)

(52) U.S. Cl. ..... 347/116; 347/249; 347/248; 347/234

(58) Field of Classification Search ..... 347/116, 347/234, 248, 249

See application file for complete search history.

(56) References Cited

U.S. PATENT DOCUMENTS 7,133,056 B2 * 11/2006 Tanaka et al. ..... 347/116
2005/0212887 A1 9/2005 Tanaka et al.

FOREIGN PATENT DOCUMENTS

JP 5-188697 A 7/1993
JP 8-305108 A 11/1996
JP 9-244332 A 9/1997
JP 2004-198946 A 7/2004

OTHER PUBLICATIONS

Machine-generated translation of JP 8-305108, published on Nov. 1996.*

European search report for Application No. 08250124.8-2209; Dated May 26, 2008; with English translation.

* cited by examiner

*Primary Examiner* — Huan Tran

(74) *Attorney, Agent, or Firm* — Cantor Colburn LLP

(57) ABSTRACT

A color image forming apparatus including: an image forming section which forms an image based on image information on an image carrier provided in the image forming section; a detection section which detects a print mark for color misalignment correction formed on the image carrier by the image forming section, and outputs print mark detection information; and a control section for executing color misalignment correction control based on the print mark detection information outputted from the detection section, wherein, the control section obtains a trend of a color misalignment amount of the print mark by statistically processing data of the result of the print mark detection, calculates an execution timing of color misalignment correction base on the obtained trend, and executes the color misalignment correction at the calculated execution timing.

16 Claims, 16 Drawing Sheets

CR
12(A)
(i)
θ
SUB SCANNING DIRECTION
(ii)

L1
S2
Lth
a
b
c
d
L2

VTOP

SP=Dp
t0
ta
tb
tc
td
FIG. 10 (E) D[T1]
T1
FIG. 10 (F) D[T2]
T2
FIG. 10 (G) D[T3]
T3
FIG. 10 (H) D[T4]
T4

COLOR IMAGE FORMING APPARATUS AND IMAGE FORMING METHOD

CROSS REFERENCE TO RELATED APPLICATION

The present application is based on Japanese Patent Application No. 2007-011719 filed with Japanese Patent Office on Jan. 22, 2007, the entire content of which is hereby incorporated by reference.

BACKGROUND OF THE INVENTION

1. Technical Field

The present invention relates to a color image forming apparatus, an image forming method, and a recording medium suitably applicable to a tandem system color printer and a color copying machine having photosensitive drums and an intermediate transfer belt for executing a color misalignment correction mode and a color MFP (Multi Function Peripheral) thereof.

2. Description of Prior Art

In recent years, a tandem system color printer and color copying machine and a color MFP thereof have been used often. This kind of color image forming apparatus, to maintain optimally the print quality (color reproducibility) of a color image, superimposes yellow (Y), magenta (M), cyan (C), and black (BK) for reproducing red, green, and blue of a document image on an intermediate transfer belt. To superimpose reproducibly each color of Y, M, C, and BK, in an image forming unit, it is essential to correct positively color misalignments (hereinafter, referred to as a color misalignment correction mode).

Regarding the color misalignment correction mode, a color misalignment detection mark (hereinafter, referred to as a registration mark) for position detection formed on the intermediate transfer belt or a conveying transfer belt is detected by a detection section (hereinafter, referred to as a registration sensor) for color misalignment detection such as a reflection sensor, and the color misalignment amounts of registration marks of the other colors to the reference color registration mark are calculated and are fed back to each image forming unit of Y, M, and C so as to eliminate the color misalignment amounts, and the laser writing timing is corrected, thus a good color image can be obtained.

In relation to an apparatus having such a color misalignment correction mode, in Japanese Unexamined Patent Application Publication 5-188697 (JPA5-188697), an image forming apparatus is disclosed. According to this image forming apparatus, regarding the color registration correction timing, the correcting section, according to the cumulative time measured from the point of time when the image forming apparatus is powered, so as to postpone slowly the correction process start interval, controls the correction process start timing. When the apparatus is structured like this, for color misalignments due to the environmental temperature, the image formation interruption time can be minimized.

Further, in Japanese Unexamined Patent Application Publication 8-305108 (JPA8-305108), an image forming apparatus and a registration correction method therefor are disclosed. According to the registration correction method, from the registration execution history, the necessity of execution of the color misalignment correction mode is decided sequentially. By use of such a method, there is no need to perform a useless correction.

Furthermore, according to the image forming apparatus disclosed in Japanese Unexamined Patent Application Publication 9-244332 (JPA 9-244332), there are two kinds of color registration correction timing modes available and from the difference between the temperature of the exposure section and another intra-apparatus temperature, the color misalignment correction mode is selected. When the apparatus is structured like this, an image displacement can be corrected at optimum timing.

Further, according to the image forming apparatus disclosed in Japanese Unexamined Patent Application Publication 2004-198946 (JPA2004-198946), registration pattern marks are formed between recording sheets and the color misalignment correction process is performed. When the apparatus is structured like this, the color misalignment can be corrected without causing downtime.

On the other hand, according to the image forming apparatus relating to the conventional example, there are the following problems imposed.

i. Conventionally, in consideration of changes in the fixing temperature, the number of fed sheets, and the time period from the preceding correction, there are found many cases in which a correction condition is decided as a set value, and the execution time of the next color misalignment correction process is decided, and they are set as fixed values. However, even in consideration of all the conditions, it is difficult to take a perfect correlation between the image misalignment amount and the time period. As mentioned above, whether or not to execute the color registration correction process is often decided by the intra-apparatus temperature rise and number of fed sheets. If the interval of the color registration correction process is set short, the productivity and toner consumption are influenced, so that the color registration correction process is limited.

ii. According to JPA5-188697, regarding the color registration correction timing, according to the cumulative time measured from the point of time when the image forming apparatus is powered, the correction process start interval is postponed slowly, though if the concerned interval is set long, there is a fear of reduction in the image quality.

iii. According to JPA8-305108, from the registration execution history, the necessity of execution of the color misalignment correction mode is decided sequentially, though if the color misalignment time does not come and the color misalignment correction mode must be executed, it is difficult to judge the necessity. A color misalignment occurrence cause is fluid and in the transition period between the preceding correction process and the present correction process, stable images are not always outputted at the preceding correction amount.

iv. According to JPA9-244332, from the difference between the temperature of the exposure section and another intra-apparatus temperature, the color misalignment correction mode is selected, though it is very difficult to confirm completely the effect of the mounting position of the temperature sensor and the time period from the point of time when the preceding correction process ends on an image by the concerned temperature sensor.

v. According to JPA2004-198946, registration pattern marks are formed on an endless belt corresponding to the intervals between recording sheets and the color misalignment process is performed. In this case, it is difficult to determine the appropriate timing of color registration correction mode since data of color misalignment amount usually deviate in large extent.

vi. By the way, as shown in FIG. 16, a method for forming images at both ends outside the image area Ia on an intermediate transfer belt 6 and during forming the images on the intermediate transfer belt 6, executing the color misalignment correction mode may be considered. According to this kind of outside-image pattern detection example, it is necessary to mount a photosensitive drum with a width W' covering the image area and an intermediate transfer belt with a width equal to the width W', thus it results in obstruction to reduction in cost of the image forming apparatus.

Therefore, the present invention was developed to solve the aforementioned problems and is intended to provide a color image forming apparatus, an image forming method, and a recording medium for shortening overall the color misalignment correction time compared with the conventional color misalignment correction mode and improving the productivity of the concerned apparatus.

SUMMARY

Embodiments reflecting some aspects of the invention to solve the above-mentioned problems are:

(1) A color image forming apparatus including:

an image forming section which forms an image based on image information on an image carrier provided in the image forming section;

a detection section which detects a print mark for color misalignment correction formed on the image carrier by the image forming section, and outputs print mark detection information; and a control section for executing color misalignment correction control based on the print mark detection information outputted from the detection section, wherein operations of stopping an image forming process to form an image based on the image information onto the image carrier, executing an image forming process to form a first print mark for color misalignment correction onto the image carrier, detecting the first print mark, and executing the color misalignment correction based on a detection result of the first print mark are assumed to be operations of a color misalignment correction mode, and operations of forming a second print mark for color misalignment correction onto an image boundary area of the image carrier, detecting the second print mark, and judging whether or not to execute the color misalignment correction mode based on a result of the second print mark detection, are assumed to be operations of a correction judgment mode, wherein the image boundary area, is an area on the image carrier between an image area of a page and an image area of the next page, images of both the pages being formed on the image carrier based on the image information, wherein, in the correction judgment mode, the control section obtains a trend of a color misalignment amount of the second print mark by statistically processing data of the result of the second print mark detection, calculates an execution timing of color misalignment correction based on the obtained trend, and executes the color misalignment correction mode at the calculated execution timing.

(2) The color image forming apparatus of (1), in the correction judgment mode, the control section compares the obtained trend of the color misalignment amount of the second print mark with a prescribed threshold value, calculates a timing when a color misalignment amount in the trend reaches the threshold value, and determines the timing as the execution timing of the color misalignment correction mode.

(3) The color image forming apparatus of (1), in the correction judgment mode, the control section executes an averaging processing and an interpolating processing of the data of the result of the second print mark detection to obtain the trend of the color misalignment amount.

(4) The color image forming apparatus of (1), wherein a either one of a main scanning dedicated print mark which enables an analysis of the color misalignment amount in a main scanning direction, a sub scanning dedicated print mark which enables analysis of the color misalignment amount in a sub scanning direction, or a composite print mark combining the main scanning dedicated print mark and the sub scanning dedicated print mark is selectable as a print mark for color misalignment correction, and the image forming section forms a preliminary selected print mark for color misalignment correction on the image carrier, where a width direction of the image carrier is assumed as the main scanning direction and a direction perpendicular to the main scanning direction is assumed as the sub scanning direction.

(5) The color image forming apparatus of (1), wherein the detection section has a plurality of optical sensors and the optical sensors are arranged at positions over the image carrier at predetermined intervals and detect images formed in the image boundary area of the image carrier.

(6) The color image forming apparatus of (1), wherein the image forming section has a writing unit for exposing the image information in batch with a unit of each line with respect to the image carrier, the writing unit comprising a plurality of light sources arranged in line along the main scanning direction of the image carrier.

(7) The color image forming apparatus of (1), wherein the image forming section has a writing unit for exposing the image information for each pixel with respect to the image carrier, the writing unit comprising a light source for deflecting and scanning a light beam in the main scanning direction of the image carrier.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Hereinafter, the color image forming apparatus, image forming method, and recording medium relating to the embodiments of the present invention will be explained with reference to the accompanying drawings.

Figure 1:
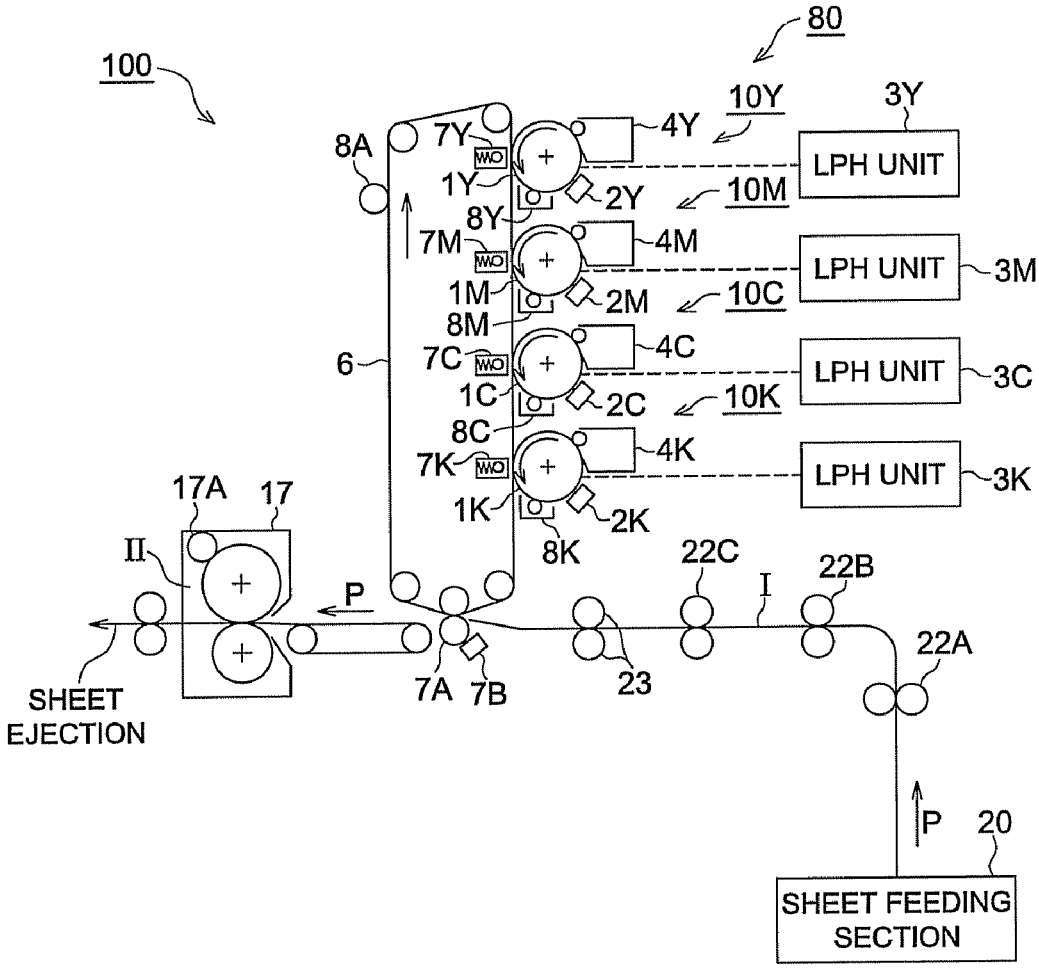
FIG. 1 is a conceptual diagram showing a constitution example of a color printer 100 of the embodiments of the present invention.

FIG. 1 is a conceptual diagram showing a constitution example of the color printer 100 of the embodiments of the present invention. The color printer 100 shown in FIG. 1 composes an example of the tandem system color image forming apparatus, which on the basis of input image data (image information), superimposes colors on an intermediate transfer belt 6 (image carrier) and forms a color image. The color printer 100 executes the correction judgment mode and executes the color misalignment correction mode on the basis of judgment results by the correction judgment mode. Here, the correction judgment mode is referred to as an operation of writing an image for color misalignment correction in the image boundary area of the intermediate transfer belt 6, detecting the concerned image, processing statistically the detection results of the image, and discriminating whether or not to execute the color misalignment correction mode.

The image boundary area is referred to as an area held between the image area on the concerned page formed on the intermediate transfer belt 6 on the basis of input image data and the image area on the next page. Hereinafter, it may be referred also to as a sheet interval. Further, the color misalignment correction mode is referred to as an operation of stopping the image writing process onto the intermediate transfer belt 6 based on input image data, executing the writing process of the image for color misalignment correction for the intermediate transfer belt 6 via photosensitive drums 1Y, 1M, 1C, and 1K, detecting the image, and correcting color misalignments on the basis of the detection results of the image.

The input image data is fed to the printer 100 from an external apparatus such as a personal computer and is transferred to an image forming section 80. The image forming section 80 is composed of an image forming unit 10Y having the photosensitive drum 1Y for yellow (Y), an image forming unit 10M having the photosensitive drum 1M for magenta (M), an image forming unit 10C having the photosensitive drum 1C for cyan (C), an image forming unit 10K having the photosensitive drum 1K for black (K), and the endless intermediate transfer belt 6. In the image forming section 80, the imaging operation is performed for each of the photosensitive drums 1Y, 1M, 1C, and 1K, and toner images of the respective colors subject to the imaging process on the photosensitive drums 1Y, 1M, 1C, and 1K of the respective colors are superimposed on the intermediate transfer belt 6, thus a color image is formed. The photosensitive drums 1Y, 1M, 1C, and 1K and the intermediate transfer belt 6 compose an example of the image carrier.

In this example, the image forming unit 10Y, in addition to the photosensitive drum 1Y, includes a main charger 2Y, an LPH unit 3Y, a developing unit 4Y, and a cleaning means 8Y for an image forming structure and forms an image of yellow (Y). The photosensitive drum 1Y, for example, is installed rotatably in the neighborhood of the right upper part of the intermediate transfer belt 6 and forms a toner image of yellow. In this example, the photosensitive drum 1Y is rotated counterclockwise. Obliquely downward on the right of the photosensitive drum 1Y, the main charger 2Y is installed and charges the surface of the photosensitive drum 1Y at a predetermined potential.

Almost right beside the photosensitive drum 1Y, opposite to it, a line photo diode head (hereinafter, referred to as an LPH unit 3Y) is installed and to the photosensitive drum 1Y charged beforehand, a laser beam having a predetermined intensity based on the image data for yellow is irradiated in a batch. As an LPH unit 3Y, a one, not drawn, with an LED head arranged in line is used. On the photosensitive drum 1Y, an electrostatic latent image for yellow is formed.

Above the LPH unit 3Y, the developing unit 4Y is installed and operates so as to develop the electrostatic latent image for yellow formed on the photosensitive drum 1Y. The developing unit 4Y has a developing roller for yellow not drawn. In the developing unit 4Y, a toner material for yellow and a carrier are stored.

The developing roller for yellow has a magnet arranged internally, rotates and conveys a two-component developer obtained by stirring the carrier and yellow toner material in the developing unit 4Y to the opposite part of the photosensitive drum 1Y and develops the electrostatic latent image by the yellow toner material. The Y toner image formed on the photosensitive drum 1Y is transferred (primary transfer) to the intermediate transfer belt 6 by operating a primary transfer roller 7Y. Under the photosensitive drum 1Y on the left thereof, the cleaning section 8Y is installed and removes (cleans) the toner material remaining on the photosensitive drum 1Y by the preceding writing.

In this example, under the image forming unit 10Y, the image forming unit 10M is installed. The image forming unit 10M includes the photosensitive drum 1M, a main charger 2M, an LPH unit 3M, a developing unit 4M, and a cleaning section 8M for an image forming structure and forms an image of magenta (M). Under the image forming unit 10M, the image forming unit 10C is installed. The image forming unit 10C includes the photosensitive drum 1C, a main charger 2C, an LPH unit 3C, a developing unit 4C, and a cleaning section 8C for an image forming structure and forms an image of cyan (C).

Under the image forming unit 10C, the image forming unit 10K is installed. The image forming unit 10K includes the photosensitive drum 1K, a main charger 2K, an LPH unit 3K, a developing unit 4K, and a cleaning section 8K for an image forming structure and forms an image of black (BK). For the photosensitive drums 1Y, 1M, 1C, and 1K, an organic photo conductor (OPC) drum is used.

The functions of the members of the image forming units 10M to 10K can be applied to the same numerals as those of the image forming unit 10Y by changing Y to M, C, and K, so that the explanation thereof will be omitted. To the primary transfer rollers 7Y, 7M, 7C, and 7K aforementioned, a primary transfer bias voltage having the reverse polarity (the positive polarity in this embodiment) of that of the toner material used is impressed.

The intermediate transfer belt 6 superimposes the toner images transferred by the primary transfer rollers 7Y, 7M, 7C, and 7K and forms a color toner image (a color image) The color image formed on the intermediate transfer belt 6, since the intermediate transfer belt 6 rotates clockwise, is conveyed toward a secondary transfer roller 7A. The secondary transfer roller 7A is positioned under the intermediate transfer belt 6 and transfers the color toner images formed on the intermediate transfer belt 6 to a sheet P in a batch (secondary transfer). The secondary transfer roller 7A removes (cleans) the toner material remaining on the secondary transfer roller 7A by the preceding transfer.

In this example, on the upper left side of the intermediate transfer belt 6, a cleaning section 8A is installed and operates so as to clean the toner material remaining on the intermediate transfer belt 6 after transfer. The cleaning section 8A includes a discharging section (not drawn) for eliminating the charge of the intermediate transfer belt 6 and a pad for removing the toner remaining on the intermediate transfer belt 6. The intermediate transfer belt 6 in which the belt surface is cleaned by the cleaning section 8A and the charge is eliminated by the discharging section enters the next image forming cycle. By doing this, the color image can be formed on the sheet P.

The color printer 100, in addition to the image forming section 80, includes a sheet feed section 20 and a fixing device 17. Under the image forming unit 10K aforementioned, the sheet feed section 20 is installed and is structured so as to have a plurality of sheet feed trays not drawn. In each sheet feed tray, the sheets P with a predetermined size are stored. On the sheet conveying path from the sheet feed section 20 to under the image forming unit 10K, conveying rollers 22A and 22C, loop rollers 22B, and registration rollers 23 are installed. For example, the registration rollers 23 hold predetermined sheets P discharged from the sheet feed section 20 before the secondary transfer roller 7A and sends them to the secondary transfer roller 7A in accordance with the image timing. The secondary transfer roller 7A transfers the color image carried by the intermediate transfer belt 6 to the predetermined sheets P controlled in sheet conveyance by the registration rollers 23.

On the downstream side of the secondary transfer roller 7A, the fixing device 17 is installed and performs the fixing process for the sheets P with the color image transferred. The fixing device 17 includes a fixing roller, a pressing roller, and a heater (IH) which are not drawn and a fixing cleaning section 17A. The fixing process permits the sheets P to pass between the fixing roller and the pressing roller which are heated by the heater, thus the sheets P are heated and pressurized. The sheets P after fixing are held between ejection rollers and are ejected onto a sheet receiving tray (not drawn) outside the apparatus. The fixing cleaning section 17A removes (cleans) the toner material remaining on the fixing roller by the preceding fixing.

Figure 2:
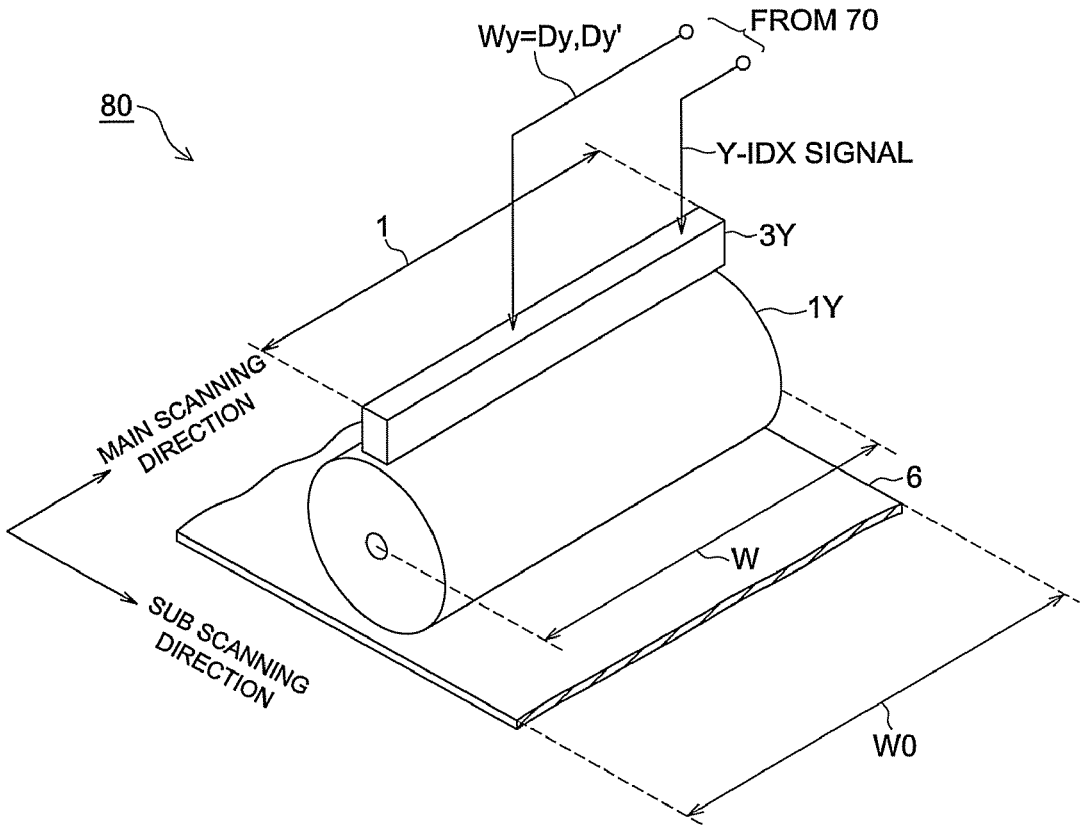
FIG. 2 is a perspective view showing an arrangement example of an LPH unit 3Y of an image forming section 80.

FIG. 2 is a perspective view showing an arrangement example of the LPH unit 3Y of the image forming section 80. In the image forming section 80 shown in FIG. 2, the LPH unit 3Y for yellow composing an example of the writing unit is installed and in the correction judgment mode, a yellow image suppressing the toner print amount to its minimum is written at sheet intervals. The LPH unit 3Y is arranged opposite to the photosensitive drum 1Y, has a plurality of light sources arranged in line in the main scanning direction of the photosensitive drum 1Y, and operates so as to expose a laser beam based on image data Dy for yellow to the photosensitive drum 1Y in each line in a batch. By this exposure in a batch, an electrostatic latent image is formed on the photosensitive drum 1Y in each line.

The LPH unit 3Y has a length 1 equal to the overall width W of the photosensitive drum 1Y and on the basis of a write permission (index) signal (hereinafter, referred to as a Y-IDX signal) for yellow, operates so as to write yellow image data Dy in correspondence to one line or to several lines in a batch in the main scanning direction (ordinary operation mode). In the ordinary operation mode, the LPH unit 3Y writes the electrostatic latent image on the concerned page in the photosensitive drums 1Y, 1M, 1C, and 1K, toner-develops the electrostatic latent image, then transfers the toner image to the intermediate transfer belt 6, transfers the toner image transferred to the intermediate transfer belt 6 to a sheet, and fixes it.

Here, the main scanning direction is the width direction of the intermediate transfer belt 6 shown in FIG. 2, which is a direction parallel with the rotary shaft of the photosensitive drum 1Y. The photosensitive drum 1Y rotates in the sub scanning direction. The sub scanning direction is a direction orthogonal to the main scanning direction, which is the length direction of the intermediate transfer belt 6. The intermediate transfer belt 6 is moved in the sub scanning direction at a fixed linear speed. The photosensitive drum 1Y rotates in the sub scanning direction and by the exposure in each line in a batch in the main scanning direction by the LPH unit 1Y, an electrostatic latent image for yellow is formed on the photosensitive drum 1Y.

Although not drawn, the LPH units 3M, 3C, and 3K for other colors have a similar length and on the basis of an M-IDX signal, a C-IDX signal, and a K-IDX signal for each color, the LPH units 3M, 3C, and 3K operate so as to merge similarly M image data Dm, C image data Dc, and BK image data Dk and write them in a batch. A Y-IDX signal, an M-IDX signal, a C-IDX signal, and a K-IDX signal for each color are supplied from a control section 15 shown in FIG. 7. For the LPH units 3Y, 3M, 3C, and 3K, although depending on the maximum width of sheets handled by the printer 100, a one in which the LED head has several thousands to several tens thousands pixels in each line is used.

Further, the intermediate transfer belt 6 shown in FIG. 2, to transfer toner images formed by the photosensitive drums 1Y to 1K to sheets P not drawn, has a belt width W0 almost equal to the exposure enable width W of the photosensitive drums 1Y to 1K. For example, the intermediate transfer belt 6 has a belt width W0 longer than the short side of an A3-sized sheet P. When the image forming section 80 is structured as mentioned above, on the basis of an image written in each line, the trend of the color misalignment amount can be predicted.

Figure 3:
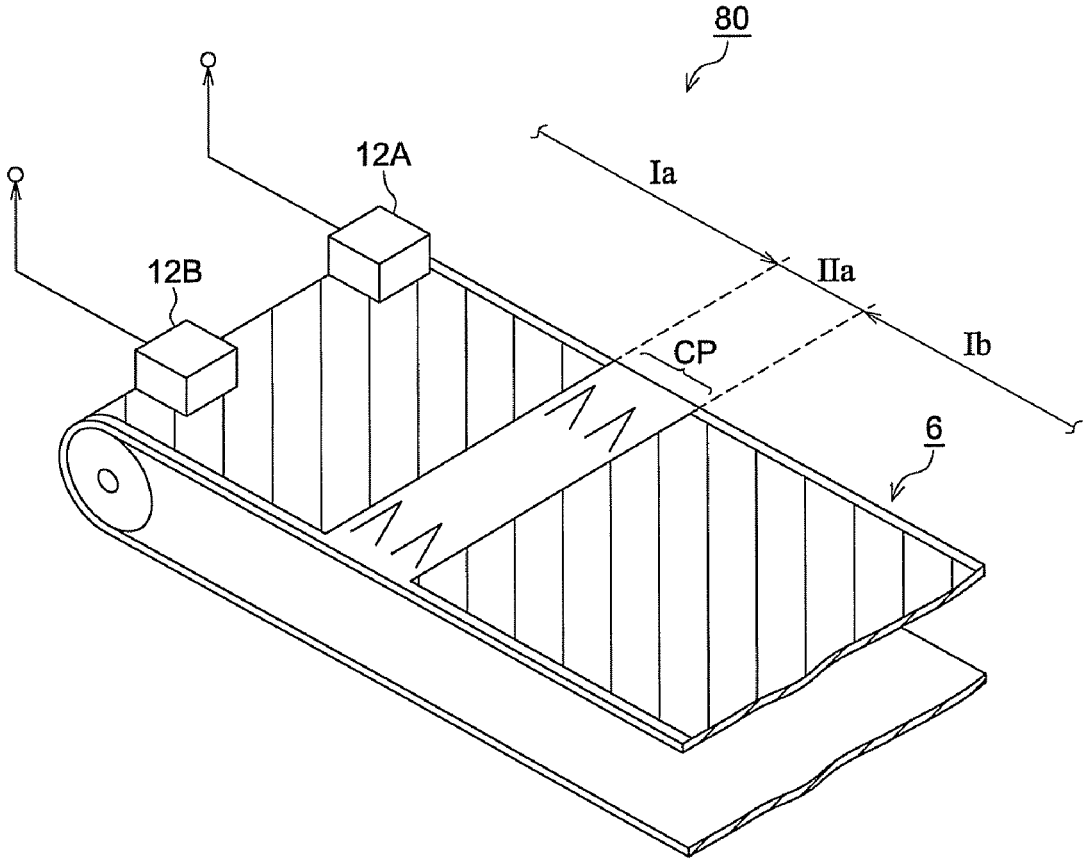
FIG. 3 is a perspective view showing a detection example of an image by two registration sensors 12A and 12B.

FIG. 3 is a perspective view showing a detection example of an image by the two registration sensors 12A and 12B. The registration sensors 12A and 12B shown in FIG. 3 compose an example of the detection section, detect an image for color misalignment correction formed on the intermediate transfer belt 6 by the image forming section 80, and output image information. For example, the registration sensors 12A and 12B are arranged in an area for easily seeing overall the intermediate transfer belt surface and on a predetermined position on the intermediate transfer belt 6 at a predetermined interval.

Figure 6:
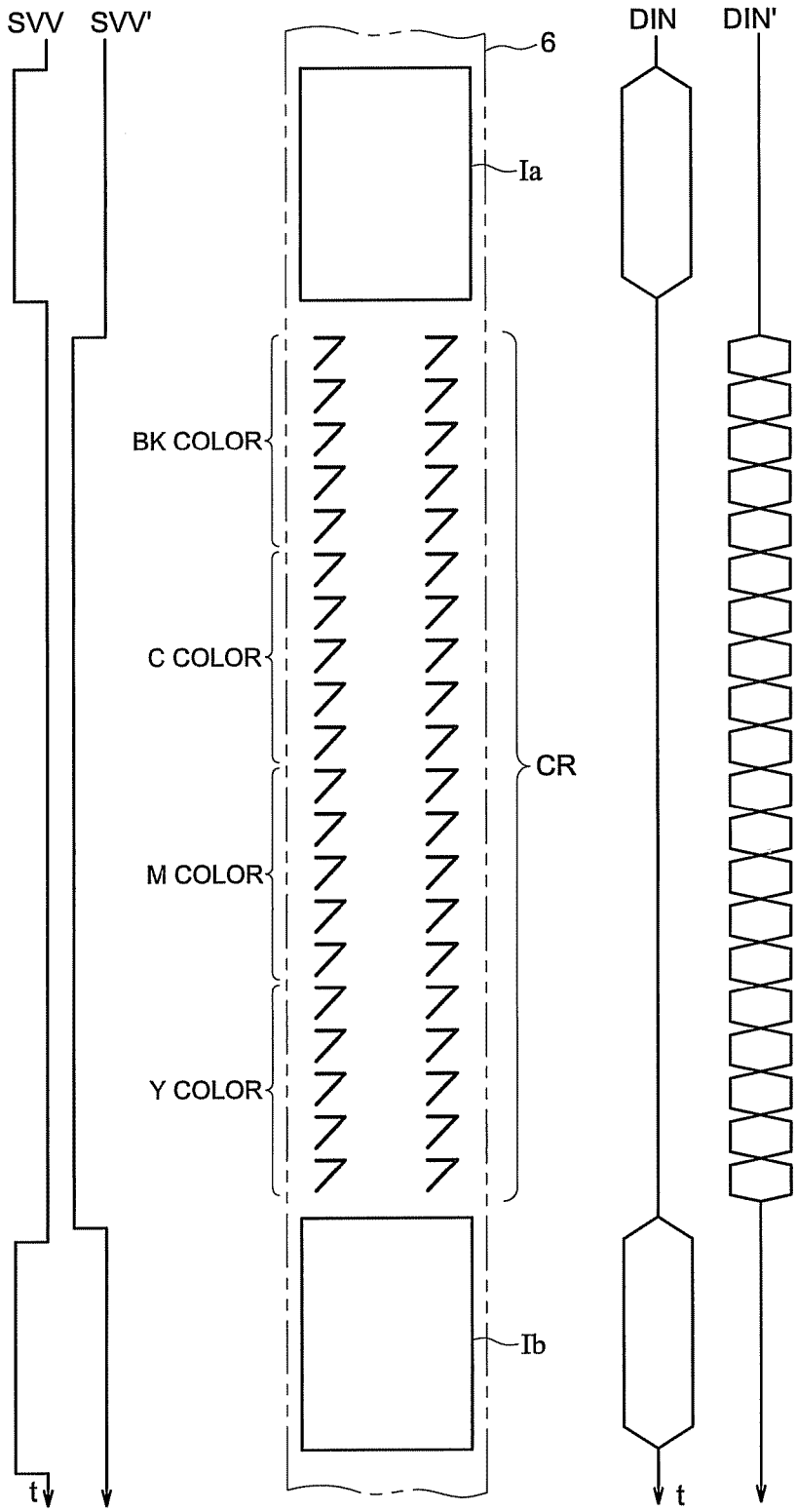
FIGS. 6(A) to 6(E) are drawings showing relation examples of the signals SVV and SVV', pre-mark CP, and data DIN and DIN' when the color misalignment correction mode is set.

The registration sensors 12A and 12B, at time of execution of the correction judgment mode and color misalignment correction mode, detect a coupler mark (hereinafter, referred to as a pre-mark CP) and a color registration mark (hereinafter, referred to as a registration mark CR) which are an example of the image formed on the intermediate transfer belt 6 by the image forming units 10Y, 10M, 10C, and 10K. The pre-mark CP is formed in the image boundary area of the intermediate transfer belt 6 during execution of the ordinary operation mode. The hatched part shown in FIG. 3 indicates image forming areas Ia and Ib based on the ordinary operation mode and the interval between the image forming areas Ia and Ib indicates an image boundary area IIa (at sheet intervals). The registration mark CR is formed on the intermediate transfer belt 6 at time of non-execution of the ordinary operation mode (refer to FIG. 6).

For the registration sensors 12A and 12B, an optical sensor or a line image sensor is used. The registration sensors 12A and 12B are arranged in the image area of the intermediate transfer belt 6 with a width W. When the registration sensors 12A and 12B are arranged like this, at time of execution of the correction judgment mode, an image necessary for the statistical process for predicting the execution time of the color misalignment correction mode can be obtained little by little. The image information aforementioned is outputted from the registration sensor 12A to the control section 15. The control section 15, on the basis of the image detection information outputted from the registration sensor 12A, executes the color misalignment correction control.

Figure 4:
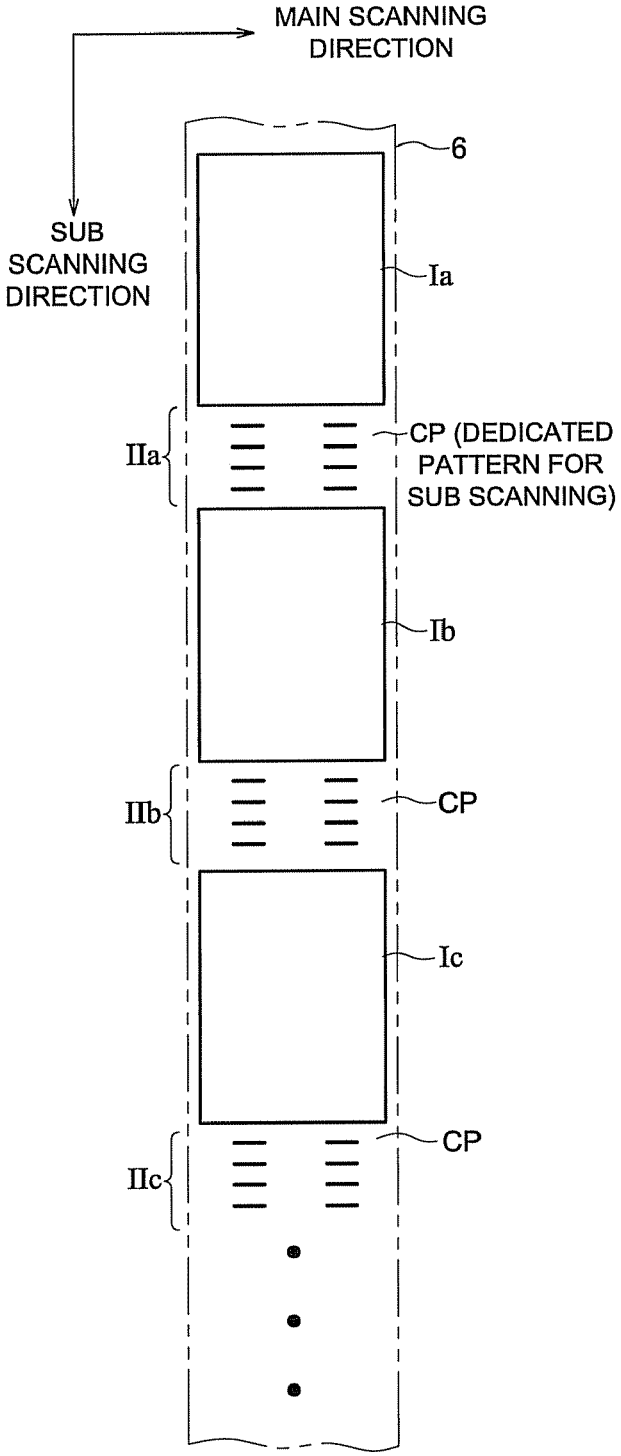
FIGS. 4(A) and 4(B) are drawings showing forming examples of a pre-mark CP.
Figure 4:
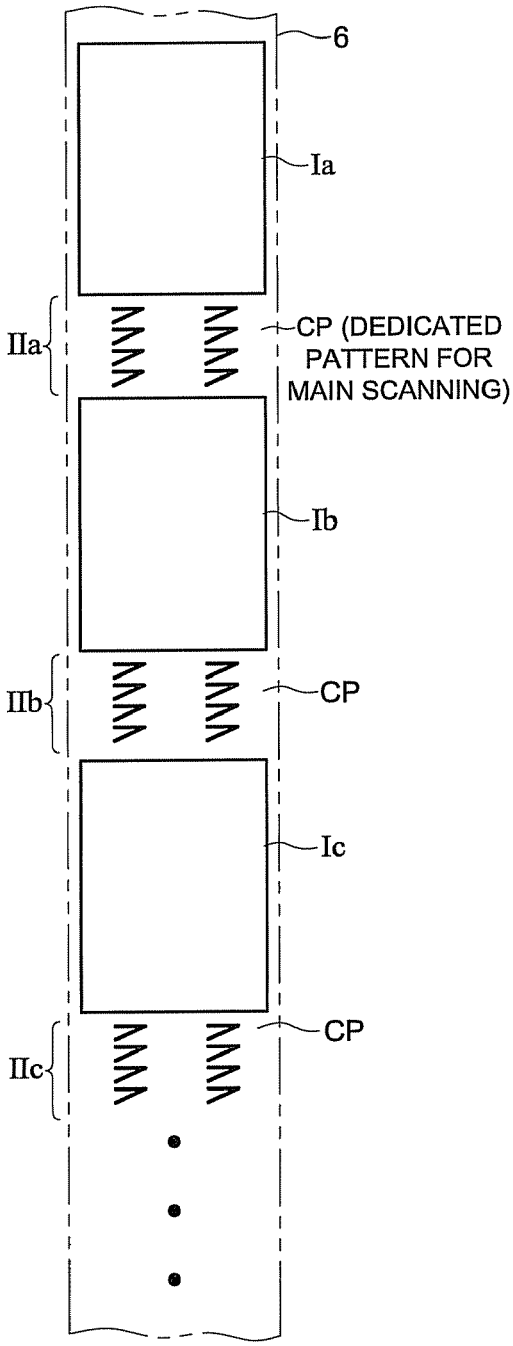

FIGS. 4A and 4B are drawings showing forming examples of the pre-mark CP. FIG. 4A is a drawing showing a dedicated pattern example for sub scanning and FIG. 4B is a drawing showing a dedicated pattern example for main scanning.

In this embodiment, the color registration correction timing as a fixed value condition is set in the color misalignment correction mode, while in addition to the color registration correction timing, the correction judgment mode is executed and the timing (execution time) for executing the color misalignment correction mode is decided. In the correction judgment mode, the LPH units 3Y, 3M, 3C, and 3K write pre-marks CP of Y, M, C, and BK at sheet intervals at a minimum print rate.

The dedicated patterns for sub scanning shown in FIG. 4A are images for enabling analysis of the color misalignment amount in the sub scanning direction. According to the dedicated pre-marks CP for sub scanning, linear pre-marks CP of Y, M, C, and BK parallel with the main scanning direction are formed in the image boundary areas IIa, IIb, - - - between the image forming areas Ia and Ib and between the image forming areas Ib and Ic. To the LPH units 3Y, 3M, 3C, and 3K, the dedicated pre-mark CP for sub scanning is applied. The reason is that the LPH unit 3Y and others, compared with a writing unit of a polygon mirror scanning form, do not scan a laser beam in the main scanning direction.

The dedicated patterns for main scanning shown in FIG. 4B are images for enabling analysis of the color misalignment amount in the main scanning direction and are applied to the writing unit of the polygon mirror scanning form. According to the dedicated pre-marks CP for main scanning, pre-marks CP in a "∠" shape are formed in the image boundary areas IIa, IIb, - - - between the image forming areas Ia and Ib and between the image forming areas Ib and Ic. Each pre-mark CP in a "∠" shape has a linear part in parallel with the main scanning direction and an inclined part extending slantwise in the sub scanning direction from one end of the linear part.

The dedicated pre-marks CP for main scanning may be ones in which only the inclined parts are arranged side by side. Needless to say, the inclined part and linear part may be composed in a reverse "∠" shape. The number of dedicated patterns for main or sub scanning formed in the image boundary areas IIa and IIb is not limited respectively to one. The number of the concerned patterns may be two and the number of colors of the concerned pattern may be two. According to the writing units of the image forming units 10Y, 10M, 10C, and 10K, the kind and number of dedicated patterns for main or sub scanning may be made different from each other. The concerned patterns, in correspondence to the number of the registration sensors 12A and 12B installed, may be arranged in a plurality of rows in the main scanning direction.

The dedicated pre-marks CP for sub scanning or the dedicated pre-marks CP for main scanning and the composite pre-marks CP thereof can be selected as a pre-mark CP for color misalignment correction and the image forming section 80 forms the preselected pre-marks CP for color misalignment correction on the intermediate transfer belt 6.

When the pre-marks CP are structured so as to be selectable like this, at time of execution of the correction judgment mode, by detecting a few dedicated pre-marks CP for main scanning written at sheet intervals, the color misalignment amount in the main scanning direction can be analyzed and by detecting the dedicated pre-marks CP for sub scanning written similarly, the color misalignment amount in the sub scanning direction can be analyzed.

Further, by detecting the composite pre-marks CP thereof, the color misalignment amounts in the main and sub scanning directions can be analyzed. By the detection and analysis process, the change thereof is predicted statistically and the execution time (timing) of the color misalignment correction mode (color registration correction process) can be decided. For the prediction process of statistical changes, the extrapolation such as the linear interpolation prediction can be used.

FIGS. 5(A) to 5(E) are drawings showing relation examples of the signal SVV, pre-mark CP, input image data DIN, and image data DIN' when the correction judgment mode is set.

In this example, the LPH units 3Y, 3M, 3C, and 3K, even when the set execution time of the color misalignment correction mode does not come, write a pre-mark CP of each color suppressing the toner print amount to its minimum at sheet intervals.

Figure 5:
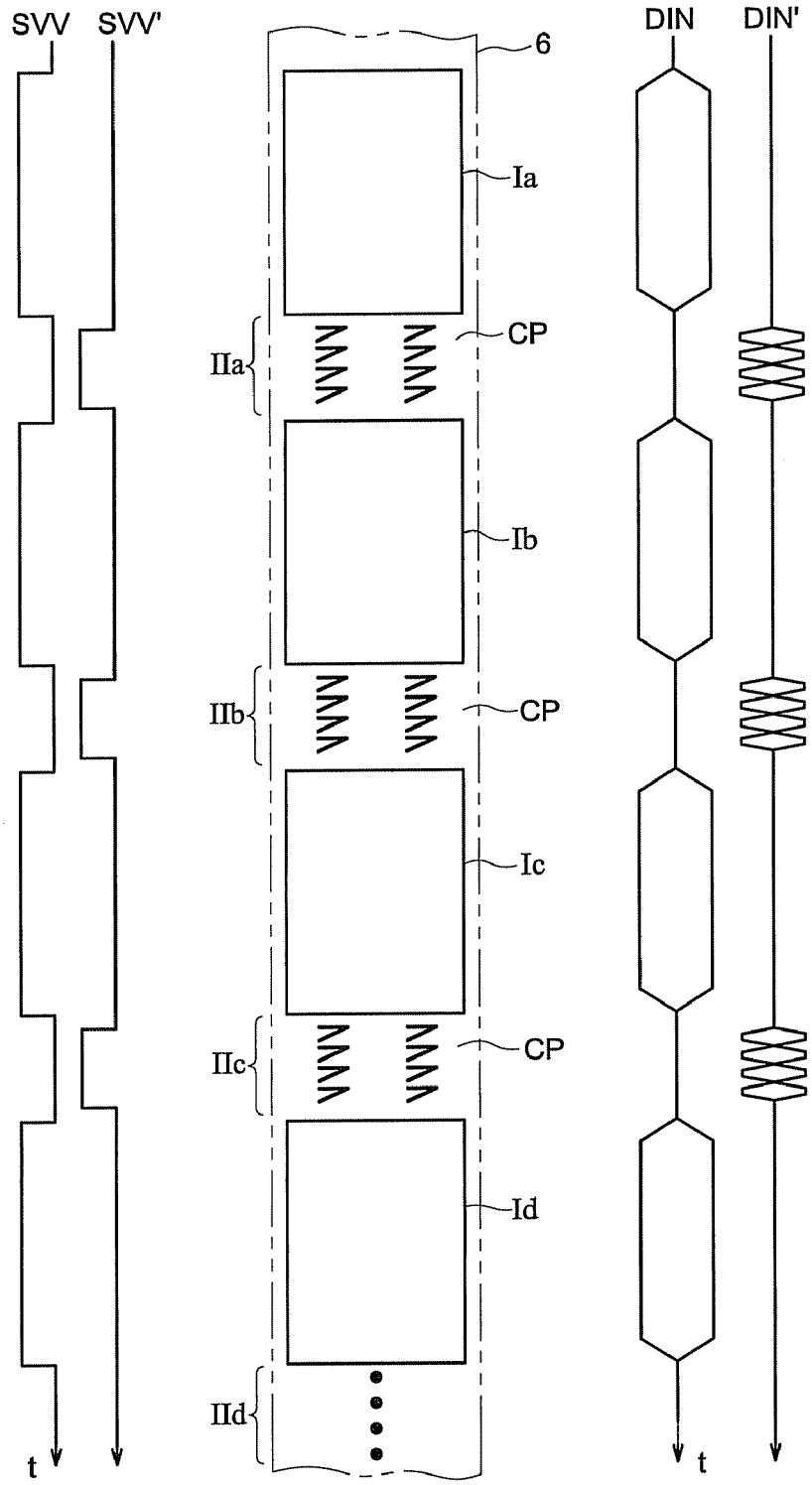
FIGS. 5(A) to 5(E) are drawings showing relation examples of signals SVV and SVV', pre-mark CP, and data DIN and DIN' when the correction judgment mode is set.

The sub scanning imaging permission signal (hereinafter, referred to as the signal SVV) shown in FIG. 5A is a control signal relating to the ordinary operation modes which is a signal indicating permission of writing on the high level and indicating non-permission of writing on the low level. The sub scanning imaging permission signal (hereinafter, referred to as the signal SVV') shown in FIG. 5B is a control signal relating to the correction judgment mode, which is a signal indicating permission of writing on the high level and indicating non-permission of writing on the low level. The signal SVV' is a signal for deciding the image boundary area on the intermediate transfer belt 6.

When the correction judgment mode is set in this example, in the section where the signal SVV shown in FIG. 5A becomes high, on the basis of the input image data DIN relating to the ordinary operation mode shown in FIG. 5D, an image is formed on the intermediate transfer belt 6. In this section, the signal SVV' shown in FIG. 5B is low. Thereafter, when the signal SVV shown in FIG. 5A becomes low and the signal SVV' shown in FIG. 5B becomes high, on the basis of the image data DIN' relating to the correction judgment mode shown in FIG. 5E, the pre-mark CP is formed on the intermediate transfer belt 6. In this section, the signal SVV shown in FIG. 5A is low.

Therefore, as shown in FIG. 5C, between the image forming areas Ia and Ib of the intermediate transfer belt 6 during execution of the ordinary operation mode, between the image forming areas Ib and Ic, and in the image boundary areas IIa, IIb, IIc, - - - between the image forming areas Ic and Id, the pre-mark CP can be formed. In this example, between the first image forming area Ia and the next image forming area Ib, for example, five yellow pre-marks CP are formed in two rows (that is, ten pre-marks). Furthermore, between the next image forming area Ib and the image forming area Ic, for example, five magenta pre-marks CP are formed in two rows (that is, 5×2=10 pre-marks in total). Furthermore, between the next image forming area Ic and the image forming area Id, for example, five cyan pre-marks CP are formed in two rows (that is, 5×2=10 pre-marks in total).

Further, in the input image data DIN shown in FIG. 5D, the image data Dy, Dm, Dc, and Dk of the respective colors relating to the ordinary operation mode are included In the image data DIN' shown in FIG. 5E, image data Dy', Dm', Dc', and Dk' for each color misalignment correction relating to the correction judgment mode are included. The pre-mark CP formed in the image boundary area between the image forming areas on the intermediate transfer belt 6 is detected by the registration sensors 12A and 12B at sheet intervals.

FIGS. 6(A) to 6(E) are drawings showing relation examples of the signal SVV, registration mark CR, input image data DIN, and image data DIN' when the color misalignment correction mode is set.

In this example, in the section where the signal SVV shown in FIG. 6A becomes high, on the basis of the input image data DIN relating to the ordinary operation mode shown in FIG. 6D, an image is formed on the intermediate transfer belt 6. In this section, the signal SVV' shown in FIG. 6B is low. Thereafter, when the color misalignment correction mode is set, the signal SVV shown in FIG. 6A becomes low, and the job is interrupted, and when the signal SVV' shown in FIG. 6B becomes high, on the basis of the image data DIN' relating to the color misalignment correction mode shown in FIG. 6E, the registration mark CR is formed on the intermediate transfer belt 6. The registration mark CR is used to perform the regular color registration correction process.

In this section, the signal SVV shown in FIG. 6A is kept low. Therefore, as shown in FIG. 6C, the ordinary operation mode is interrupted once and the registration mark CR can be formed on the intermediate transfer belt 6. In this example, five registration marks CR of each of yellow, magenta, cyan, and black in this order are formed in two rows (that is, 5×4×2=40 registration marks in total). Further, in the image data DIN' shown in FIG. 6E, the image data Dy', Dm', Dc', and Dk' for each color misalignment correction relating to the color alignment correction mode are included The registration mark CR formed on the intermediate transfer belt 6 is detected by the registration sensors 12A and 12B.

Figure 7:
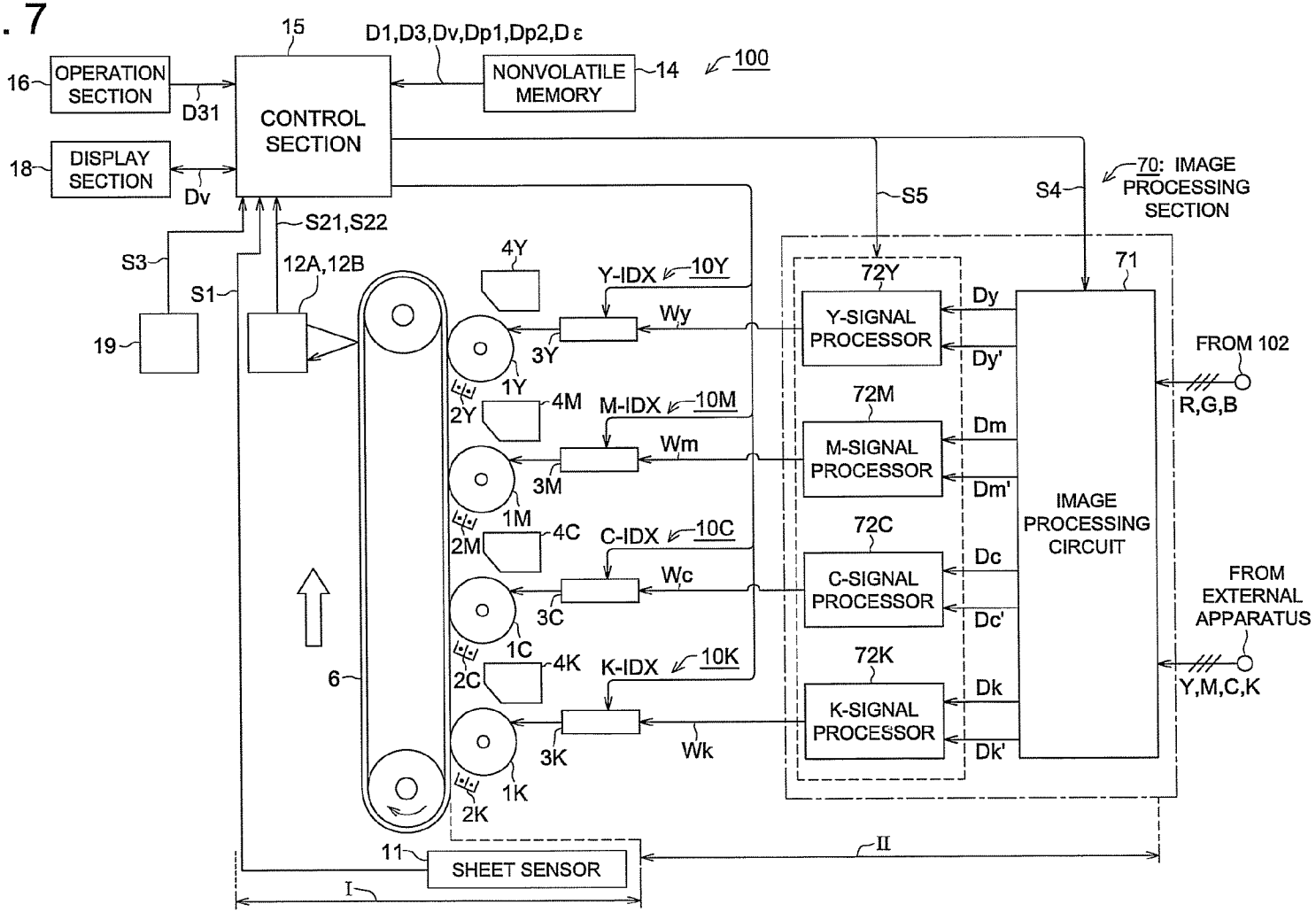
FIG. 7 is a block diagram showing a constitution example of the image transfer system I and image forming system II of the color printer 100.

FIG. 7 is a block diagram showing a constitution example of the image transfer system I and image forming system II of the color printer 100. In the color printer 100 shown in FIG. 7, the intermediate transfer belt 6, sheet sensor 11, and registration sensors 12A and 12B compose the image transfer system I and the image forming units 10Y, 10M, 10C, and 10K compose the image forming system II.

The sheet sensor 11 composing the function of the measuring section is connected to the control section 15, counts the number of sheets P fed to the image transfer system I, and then outputs a sheet count signal S1 (information on the number of fed sheets) to the control section 15. For the sheet sensor 11, for example, a counter is used. The sheet sensor 11 is not limited to the counter and any one, if it can detect the number of sheets P, is acceptable. The control section 15, on the basis of sheet count data D1 obtained by converting the sheet count signal S1 outputted from the sheet sensor 11 from analog to digital, controls the image forming units 10Y, 10M, 10C, and 10K. For example, the control section 15, on the basis of the sheet count data D1, calculates the execution time of the color misalignment correction mode.

The color printer 100 includes, in addition to the sheet sensor 11 and image transfer systems I and II, a nonvolatile memory 14, the control section 15, an operation section 16, a display section 18, a temperature sensor 19, and an image processing section 70.

In this example, the control section 15, on the basis of the temperature detection information and information on the number of fed sheets, judges whether the execution time of the color misalignment correction mode comes or not. The temperature sensor 19 composing the function of the temperature detection section is connected to the control section 15, detects the intra-apparatus temperature such as the fixing temperature in the image forming section 80, and outputs a temperature detection signal S3 (temperature detection information) to the control section 15. For the temperature sensor 19, a thermistor is used. The control section 15, on the basis of temperature detection data D3 obtained by converting the temperature detection signal S3 outputted from the temperature sensor 19 from analog to digital, controls the image forming units 10Y, 10M, 10C, and 10K. For example, the control section 15, on the basis of the temperature detection data D3, calculates the execution time of the color misalignment correction mode.

In this example, when the fixing temperature of the fixing device 17 is changed and a temperature difference A becomes 2° C., when the number of fed sheets reaches a prescribed number of sheets, when the image forming units 10Y, 10M, 10C, and 10K stop temporarily, when the main power source is turned on, or when a correction instruction is issued forcibly by a user, the control section 15 judges that the execution time of the color misalignment correction mode comes. The control section 15 has such a monitoring function, thereby, when the temperature of the image forming section 80 is higher or lower than a prescribed value or when the number of sheets fed to the image forming section 80 is larger than a prescribed value, separately from the correction judgment mode, can recognize the periodical incoming of the color misalignment correction mode.

Furthermore, the control section 15 executes serially the image forming process on the intermediate transfer belt 6 relating the ordinary operation mode and the pre-mark forming process into the image boundary area IIa relating to the correction judgment mode. In this example, even if the execution time of the color misalignment correction mode does not come, the control section 15 executes the color misalignment correction mode depending on the judgment results of the correction judgment mode. The control section 15 recognizing such an exceptional process is installed, thus even if the color misalignment correction time does not come, the control section 15 can execute flexibly, when necessary, the color misalignment correction mode.

For example, the control section, on the basis of the pre-mark detection information outputted from the registration sensor 12A, calculates the difference between the color misalignment amount of the preceding pre-mark CP and the color misalignment amount of the present pre-mark CP, judges whether the difference in the color misalignment amount of the pre-mark CP is included within the set tolerance or not, and when the difference in the color misalignment amount of the pre-mark CP is beyond the set tolerance, even if the execution time of the color misalignment correction mode does not come, executes the concerned color misalignment correction mode. The control section 15 having such an execution function is installed, thus when the difference in the color misalignment amount of the pre-mark CP is beyond the set tolerance, even if the execution time of the color misalignment correction mode does not come, the control section 15 can execute the concerned color misalignment correction mode.

Further, even if the execution time of the color misalignment correction mode comes, depending on the judgment results of the correction judgment mode by the control section 15, the color misalignment correction mode can be kept unexecuted. For example, as a result of the correction judgment mode, when "No need to execute color misalignment correction mode" is judged by the control section 15, the control section 15 can control the image forming section 80 so as not to execute the color misalignment correction mode at the present time.

In the color misalignment correction mode aforementioned, the control section 15 stops the image forming process on the intermediate transfer belt 6 relating to the ordinary operation mode and executes the registration mark forming process on the intermediate transfer belt 6. The registration sensors 12A and 12B are connected to the control section 15 and in the color misalignment correction mode, detect the registration mark CR formed on the intermediate transfer belt 6, and output image detection signals S21 and S22. In the image detection signals S21 and S22, the front end edge detection signal component and rear end edge detection signal component of the registration mark CR are included.

For the registration sensors 12A and 12B, a reflecting optical sensor or an image sensor is used. The sensors are equipped with a light emitting device and a light receiving device, and light is irradiated to the registration mark CR from the light emitting device, and the light receiving device detects the reflected light thereof. The control section 15 converts the image detection signals S21 and S22 obtained from the registration sensors 12A and 12B from analog to digital and then, on the basis of image detection data Dp1 and Dp2, controls the exposure timing of the LPH units 3Y, 3M, 3C, and 3K.

The operation section 16 is connected to the control section 15 and in the ordinary operation mode, operation data D31 when instructing image forming conditions and forced color misalignment correction by a user is inputted. The operation is performed by the user. To the control section 15, in addition to the operation section 16, the display section 18 is connected and for example, when instructing correction forcibly, on the basis of display data Dv, displays the processing contents at time of color misalignment correction. For the display section 18, a liquid crystal display is used and the liquid crystal display is used in combination with a touch panel, not drawn, composing the operation section 16.

To the control section 15, in addition to the operation section 16, the nonvolatile memory 14 composing an example of a recording medium read by a computer is connected. In the nonvolatile memory 14, a first program for stopping the image writing process into the intermediate transfer belt 6 based on the image data Dy, Dm, Dc, and Dk, executing the writing process of the registration mark CR for color misalignment correction into the intermediate transfer belt 6, detecting the registration mark CR, and executing the color misalignment correction mode for correction color misalignment on the basis of the detection results of the registration mark CR, a second program for executing the correction judgment mode for writing the pre-mark CP for color misalignment correction into the image boundary area II of the intermediate transfer belt 6, detecting the concerned pre-mark CP, processing statistically the detection results of the pre-mark CP, and discriminating whether or not to execute the color misalignment correction mode, and a third program having a step of executing the correction judgment mode and a step of executing the color alignment correction mode on the basis of the judgment results by the correction judgment mode are described.

In the nonvolatile memory 14, in addition to the aforementioned programs, the sheet count data D1, temperature detection data D3, image detection data Dp1 and Dp2, color misalignment correction data Dϵ, and display data Dv are stored. For the nonvolatile memory 14, a hard disk or an EEPROM is used. The nonvolatile memory 14 having such described programs is installed, thus the reproducibility is satisfactory, and the trend of the color misalignment amount can be predicted on the basis of the pre-mark CP, and compared with periodical execution of the color misalignment correction mode, the image quality can be improved.

To the control section 15, in addition to the nonvolatile memory 14, the image processing section 70 is connected. The image processing section 70 includes an image processing circuit 71, a Y-signal processor 72Y, an M-signal processor 72M, a C-signal processor 72C, and a K-signal processor 72K. To the image processing circuit 71, image data for Y, M, C, and K (hereinafter, referred to as image data Dy, Dm, Dc, and Dk) relating to color print is inputted from an external apparatus such as a personal computer.

The image processing circuit 71, on the basis of an image process control signal S4, outputs the image data Dy to the Y-signal processor 72Y. Here, the image data Dy is data for each page of an image forming signal for yellow relating to the job in the ordinary operation mode which is converted from analog to digital. Further, at time of execution of the color misalignment correction mode, the image processing circuit 71, on the basis of the image process control signal S4, outputs the image data Dy' for color misalignment correction to the Y-signal processor 72Y. The image data Dy' is data for forming the yellow pre-mark CP and registration mark CR.

Similarly, the image processing circuit 71, on the basis of an image process control signal S4, outputs the image data Dm to the M-signal processor 72M. Here, the image data Dm is data of an image forming signal for magenta relating to the job in the ordinary operation mode which is converted from analog to digital. Further, at time of execution of the correction judgment mode or the color misalignment correction mode, the image processing circuit 71, on the basis of the image process control signal S4, outputs the image data Dm' for color misalignment correction to the M-signal processor 72M. The image data Dm' is data for forming the magenta pre-mark CP and registration mark CR.

Further, the image processing circuit 71, on the basis of an image process control signal S4, outputs the image data Dc to the C-signal processor 72C. Here, the image data Dc is data of an image forming signal for cyan relating to the job in the ordinary operation mode which is converted from analog to digital. Furthermore, at time of execution of the correction judgment mode or the color misalignment correction mode, the image processing circuit 71, on the basis of the image process control signal S4, outputs the image data Dc' for color misalignment correction to the C-signal processor 72C. The image data Dc' is data for forming the magenta pre-mark CP and registration mark CR.

Further, the image processing circuit 71, on the basis of an image process control signal S4, outputs the image data Dk to the K-signal processor 72K. Here, the image data Dk is data of an image forming signal for black relating to the job in the ordinary operation mode which is converted from analog to digital. Furthermore, at time of execution of the correction judgment mode or the color misalignment correction mode, the image processing circuit 71, on the basis of the image process control signal S4, outputs the image data Dk' for color misalignment correction to the K-signal processor 72K. The image data Dc' is data for forming the magenta pre-mark CP and registration mark CR. The image process control signal S4 is outputted from the control section 15 to the image processing circuit 71.

The Y-signal processor 72Y selects the image data Dy or image data Dy' on the basis of a writing selection signal S5 and outputs the image data Dy or image data Dy' to the LPH unit 3Y. The LPH unit 3Y, on the basis of a Y-IDX signal, irradiates a laser beam simultaneously in each line.

The M-signal processor 72M selects the image data Dm or image data Dm' on the basis of the writing selection signal S5 and outputs the image data Dm or image data Dm' to the LPH unit 3M. The LPH unit 3M, on the basis of an M-IDX signal, irradiates a laser beam simultaneously in each line.

The C-signal processor 72C selects the image data Dc or image data Dc' on the basis of the writing selection signal S5 and outputs the image data Dc or image data Dc' to the LPH unit 3C. The LPH unit 3C, on the basis of a C-IDX signal, irradiates a laser beam simultaneously in each line.

The K-signal processor 72K selects the image data Dk or image data Dk' on the basis of the writing selection signal S5 and outputs the image data Dk or image data Dk' to the LPH unit 3K. The LPH unit 3K, on the basis of a K-IDX signal, irradiates a laser beam simultaneously in each line. The writing selection signal S5 is outputted from the control section 15 to the Y to K signal processors 72Y to 72K.

To the control section 15, in addition to the image processing section 70, the image forming units 10Y, 10M, 10C, and 10K are connected and the image forming unit 10Y, on the basis of writing data Wy for yellow outputted from the image processing section 70, via the photosensitive drum 1Y, forms a yellow toner image on the intermediate transfer belt 6. In the writing data Wy, the image data Dy in the ordinary operation mode and the image data Dy' for pre-mark formation in the correction judgment mode are included.

When the correction judgment mode is selected in this example, following the writing data Wy for one page=image data Dy, the writing data Wy for the image boundary area=image data Dy' is outputted to the LPH unit 3Y. Namely, the writing data Wy for one page relating to the ordinary operation mode=image data Dy is read from the Y-signal processor 72Y and then the image data Dy' for color misalignment correction to be written into the image boundary area of the intermediate transfer belt 6 is read serially from the Y-signal processor 72Y and is outputted to the LPH unit 3Y.

Further, when the color misalignment correction mode is selected, the writing data Wy=image data Dy' is outputted to the LPH unit 3Y. Namely, the image data Dy for image formation relating to the ordinary operation mode is shifted temporarily into the memory area and only the image data Dy' for color misalignment correction to be written into the intermediate transfer belt 6 is selected by the Y-signal processor 72Y and is outputted to the LPH unit 3Y.

The image forming unit 10M, on the basis of the writing data Wm for magenta, forms a magenta toner image on the intermediate transfer belt 6 via the photosensitive drum 1M. In the writing data Wm, the image data Dm in the ordinary operation mode and the image data Dm' for pre-mark formation in the correction judgment mode are included.

When the correction judgment mode is selected in this example, following the writing data Wm for one page=image data Dm, the writing data Wm for the image boundary area=image data Dm' is outputted to the LPH unit 3M. Namely, the writing data Wm for one page relating to the ordinary operation mode=image data Dm is read from the M-signal processor 72M and then the image data Dm' for color misalignment correction to be written into the image boundary area of the intermediate transfer belt 6 is read serially from the M-signal processor 72M and is outputted to the LPH unit 3M.

Further, when the color misalignment correction mode is selected, the writing data Wm=image data Dm' is outputted to the LPH unit 3M. Namely, the image data Dm for image formation relating to the ordinary operation mode is shifted temporarily into the memory area and only the image data Dm' for color misalignment correction to be written into the intermediate transfer belt 6 is selected by the M-signal processor 72M and is outputted to the LPH unit 3M.

The image forming unit 10C, on the basis of the writing data Wc for cyan, forms a cyan toner image on the intermediate transfer belt 6 via the photosensitive drum 1C. In the writing data Wc, the image data Dc in the ordinary operation mode and the image data Dc' for pre-mark formation in the correction judgment mode are included.

When the correction judgment mode is selected in this example, following the writing data Wc for one page=image data Dc, the writing data Wc for the image boundary area=image data Dc' is outputted to the LPH unit 3C. Namely, the writing data Wc for one page relating to the ordinary operation mode, that is, the image data Dc is read from the C-signal processor 72C and then the image data Dc' for color misalignment correction to be written into the image boundary area of the intermediate transfer belt 6 is read serially from the C-signal processor 72C and is outputted to the LPH unit 3C.

Further, when the color misalignment correction mode is selected, the writing data Wc=image data Dc' is outputted to the LPH unit 3C. Namely, the image data Dc for image formation relating to the ordinary operation mode is shifted temporarily into the memory area and only the image data Dc' for color misalignment correction to be written into the intermediate transfer belt 6 is selected by the C-signal processor 72K and is outputted to the LPH unit 3C.

The image forming unit 10K, on the basis of the writing data Wk for black, forms a black toner image on the intermediate transfer belt 6 via the photosensitive drum 1K. In the writing data Wk, the image data Dk in the ordinary operation mode and the image data Dk' for pre-mark formation in the correction judgment mode are included.

When the correction judgment mode is selected in this example, following the writing data Wk for one page=image data Dk, the writing data Wk for the image boundary area=image data Dk' is outputted to the LPH unit 3K. Namely, the writing data Wk for one page relating to the ordinary operation mode=image data Dk is read from the K-signal processor 72K and then the image data Dk' for color misalignment correction to be written into the image boundary area of the intermediate transfer belt 6 is read serially from the K-signal processor 72K and is outputted to the LPH unit 3K.

Further, when the color misalignment correction mode is selected, the writing data Wk, that is, the image data Dk' is outputted to the LPH unit 3K. Namely, the image data Dk for image formation relating to the ordinary operation mode is shifted temporarily into the memory area and only the image data Dk' for color misalignment correction to be written into the intermediate transfer belt 6 is selected by the K-signal processor 72K and is outputted to the LPH unit 3K. The LPH units 3Y, 3M, 3C, and 3K are controlled by the control section 15 so as to form the registration mark CR for color misalignment correction on the intermediate transfer belt 6 via the photosensitive drums 1Y, 1M, 1C, and 1K.

In this example, the control section 15, when detecting the registration mark CR formed on the intermediate transfer belt 6, with reference to a writing start signal (hereinafter, referred to as a VTOP signal) for permitting writing start of the registration mark CR into the photosensitive drums 1Y, 1M, 1C, and 1K, detects the front end edge detection time of the registration mark CR on the intermediate transfer belt 6 and the rear end edge detection time thereof and on the basis of the front end edge detection time of the registration mark CR and the rear end edge detection time thereof, calculates the color misalignment correction data Dϵ.

In this example, the calculation of the color misalignment amount is based on the black registration mark CR. The reason is to adjust so as to permit the writing position of a color image of Y, M, or C to coincide with the writing position of BK. For example, regarding the yellow writing position adjustment, the control section 15 detects the writing position of the black registration mark CR and the writing position of the yellow registration mark CR and from the misalignment amount between the writing position of the yellow registration mark CR and the writing position of the black registration mark CR, calculates the correction amount thereof. Similarly, regarding the magenta or cyan writing position adjustment, the control section 15 detects the misalignment amount between the writing position of the black registration mark CR and the writing position of the magenta or cyan registration mark CR and from the misalignment amount, calculates the correction amount of each color. Thereafter, the image forming positions of Y, M, and C are adjusted.

Figure 8:
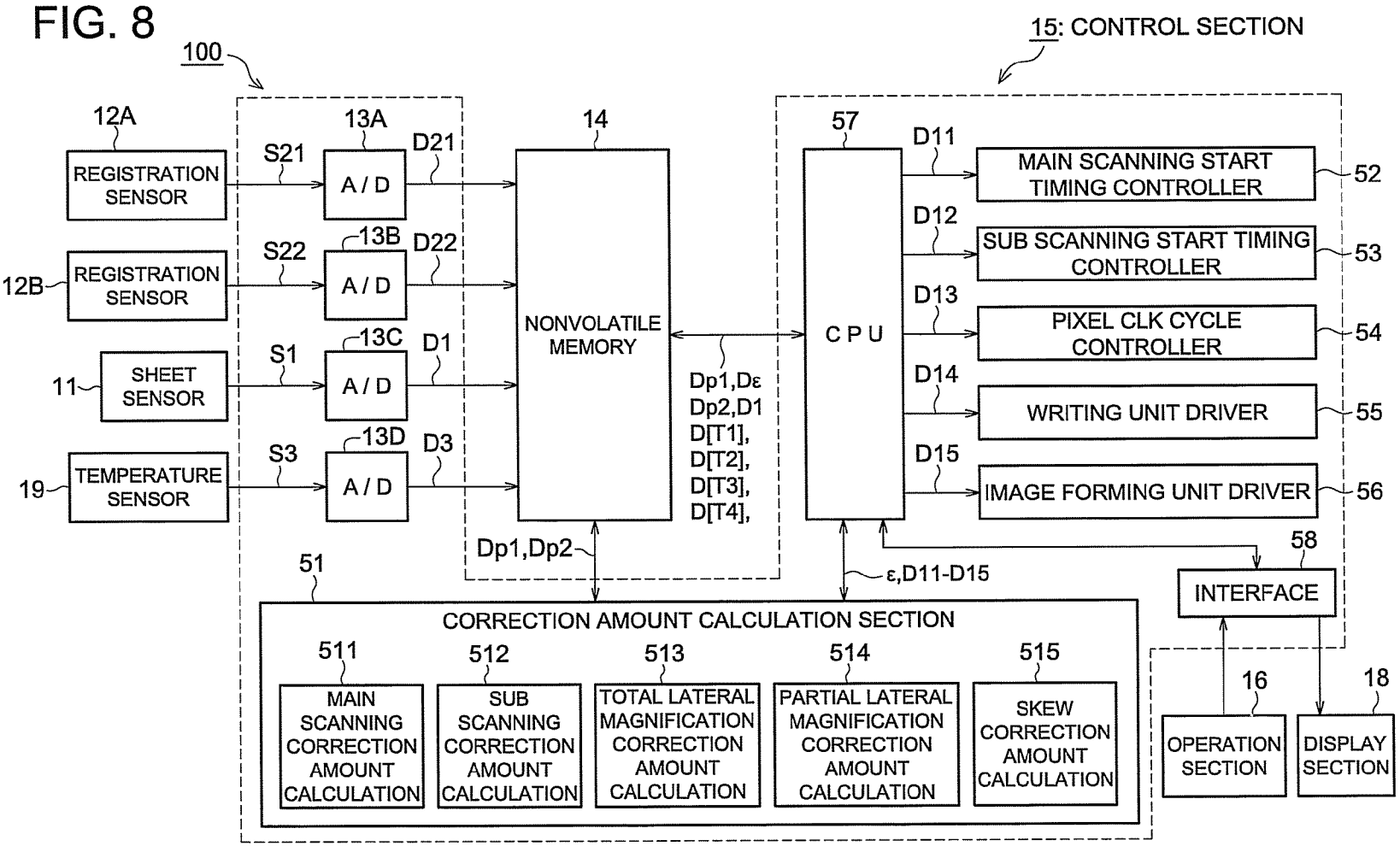
FIG. 8 is a block diagram for supplementing the constitution example of the control system of the color printer 100.

FIG. 8 is a block diagram for supplementing the constitution example of the control system of the color printer 100. The color printer 100 shown in FIG. 8 includes the sheet sensor 11, registration sensors 12A and 12B, nonvolatile memory 14, control section 15, operation section 16, display section 18, and temperature sensor 19. The control sensor 15, for example, is composed of A-D converters 13A to 13D, a correction amount calculation section 51, a main scanning start timing controller 52, a sub scanning start timing controller 53, a pixel clock cycle controller 54, a writing unit driver 55, an image forming unit driver 56, and a CPU 57.

The sheet sensor 11 is connected to the A-D converter 13C. The A-D converter 13C outputs the sheet count data D1 after the sheet count signal S1 outputted from the sheet sensor 11 is converted from analog to digital and is binarized.

The CPU 57, on the basis of the comparison results of the sheet count data D1 based on the sheet count with set sheet count data Dn as a control target, judges whether the execution time of the color misalignment correction mode comes or not. As a result of the judgment, when the number of fed sheets of the image forming section 80 is larger or smaller than a prescribed value, the CPU 57, separately from the correction judgment mode, can recognize the periodical incoming of the color misalignment correction mode. By such a function of the CPU 57, when the number of sheets fed to the image forming section 80 is larger the prescribed value, separately from the correction judgment mode, the periodical incoming of the color misalignment correction mode can be recognized.

The registration sensor 12A is connected to the A-D converter 13A. The A-D converter 13A, in the correction judgment mode or the color misalignment correction mode, outputs the image detection data Dp1 after the image detection signal S21 based on the pre-mark CP or registration mark CR which is outputted from the registration sensor 12A is converted from analog to digital and is binarized.

The registration sensor 12B is connected to the A-D converter 13B. The A-D converter 13B, in the correction judgment mode or the color misalignment correction mode, outputs the image detection data Dp2 after the image detection signal S22 based on the pre-mark CP or registration mark CR which is outputted from the registration sensor 12B is converted from analog to digital and is binarized. The A-D converters 13A to 13D are connected to the nonvolatile memory 14.

For example, the CPU 57, on the basis of the comparison results of the color misalignment amount of the pre-mark CP based on the image detection data Dp1 and Dp2 at time of pre-mark detection which are outputted from the registration sensors 12A and 12B with the preset threshold value, calculates the execution time of the color misalignment correction mode. By such a function of the CPU 57, the next execution time of the color misalignment correction mode can be set newly. For example, the CPU 57, when the execution time of the color misalignment correction mode comes, sets the next execution time of the color misalignment correction mode based on the judgment results of the correction judgment mode. By such a function of the CPU 57, the execution time of the color misalignment correction mode which is set previously can be corrected.

Further, the CPU 57 reads the image detection data Dp1 and Dp2 at time of pre-mark detection which are obtained from the registration sensors 12A and 12B from the nonvolatile memory 14, calculates the difference between the preceding color misalignment amount of the pre-mark CP and the present color misalignment amount of the pre-mark CP on the basis of the image detection data Dp1 and Dp2, judges whether the difference in the color misalignment amount of the pre-mark CP is included within the set tolerance or not, and when the difference in the color misalignment amount of the pre-mark CP is within the set tolerance, even if the execution time of the color misalignment correction mode comes, controls the image forming section 80 so as not to execute the concerned color misalignment correction mode. If the CPU 57 has such a control function, when the difference in the color misalignment amount of the pre-mark CP is within the set tolerance, even if the execution time of the color misalignment correction mode comes, the image forming section 80 can be controlled so as not to execute the concerned color misalignment correction mode.

The temperature sensor 19 is connected to the A-D converter 13D The A-D converter 13D, in the ordinary operation mode, correction judgment mode., and/or color misalignment correction mode, outputs the temperature detection data D3 after the temperature detection signal S3 based on the intra-apparatus temperature which is outputted from the temperature sensor 12A is converted from analog to digital and is binarized to the CPU 57.

The CPU 57, on the basis of the comparison results of the temperature detection data D3 based on the intra-apparatus temperature with preset temperature data Dθ relating to the control target, judges whether the execution time of the color misalignment correction mode comes or not. By this judgment function, when the intra-apparatus temperature of the image forming section 80 is higher or lower than the prescribed value, separately from the correction judgment mode, the CPU 57 can recognize the periodic incoming of the color misalignment correction mode. The CPU 57 processes statistically the detection results of the pre-mark CP, predicts the trend of the color misalignment amount of the pre-mark CP, calculates beforehand the color misalignment correction amount at time of execution of the color misalignment correction mode, and when the execution time of the color misalignment correction mode comes, executes the color misalignment correction mode on the basis of the color misalignment correction amount.

To the CPU 57, the operation section 16 is connected via an interface 58. The operation section 16 composes the function of the setting section, which is operated manually when setting the execution time of the color misalignment correction mode. The CPU 57 rewrites the execution time of the color misalignment correction mode which is set by the operation section 16 to the calculated execution time of the color misalignment correction mode. By such a function of the CPU 57, the execution time of the color misalignment correction mode can be updated.

In the nonvolatile memory 14, in addition to the sheet count data D1, image detection data Dp1 and Dp2, temperature detection data D3, and color misalignment correction data Dϵ, time period information D[T1], D[T2], D[T3], and D[T4] are stored.

The nonvolatile memory 14 is connected to the correction amount calculation section 51 and CPU 57. The correction amount calculation section 51 is composed of a main scanning correction amount calculation 511, a sub scanning correction amount calculation 512, a total lateral magnification correction amount calculation 513, a partial lateral magnification correction amount calculation 514, and a skew correction amount calculation 515. The correction amount calculation section 51, in the color misalignment correction mode or the color misalignment independent correction mode, reads the image detection data Dp1 and Dp2 from the nonvolatile memory 14, and from the image detection data Dp1 and Dp2, the misalignment amount of each error factor (main scanning, total magnification, partial lateral magnification, skew) is calculated, and from the misalignment amounts calculated here, the correction amounts of the error factors are obtained.

For example, the main scanning correction amount calculation 511 reads the image detection data Dp1 and Dp2 from the nonvolatile memory 14, calculates the position misalignment amount in the main scanning direction, and outputs timing control data D11 for adjusting the writing timing in the main scanning direction so as to eliminate the position misalignment amount. By the timing control data D11, the position misalignment in the main scanning direction is corrected.

The sub scanning correction amount calculation 512 reads the Dp1 and Dp2 from the nonvolatile memory 14, calculates the position misalignment amount in the sub scanning direction, and outputs timing control data D12 for adjusting the writing timing in the sub scanning direction so as to eliminate the position misalignment amount. By the timing control data D12, the position misalignment in the sub scanning direction is corrected.

The total lateral magnification correction amount calculation 513 reads the image detection data Dp from the nonvolatile memory 14, calculates the total lateral magnification misalignment amount, and outputs clock control data D13 for adjusting the frequency of a pixel clock signal so as to eliminate the total lateral magnification misalignment amount. By the clock control data D13, the total lateral magnification misalignment amount can be corrected.

The partial lateral magnification correction amount calculation 514 reads the image detection data Dp from the nonvolatile memory 14, calculates the partial lateral magnification misalignment amount, and outputs unit control data D14 for adjusting the inclination of the writing unit 3Y in the horizontal direction so as to eliminate the partial lateral magnification misalignment amount. By the unit control data D14, the partial lateral magnification misalignment amount can be corrected.

The skew correction amount calculation 515 reads the image detection data Dp from the nonvolatile memory 14, calculates the skew misalignment amount, and outputs skew control data D15 for adjusting the inclination of the writing unit 3Y in the vertical direction so as to eliminate the skew misalignment amount. By the skew control data D15, the skew misalignment amount can be corrected.

Figure 9:
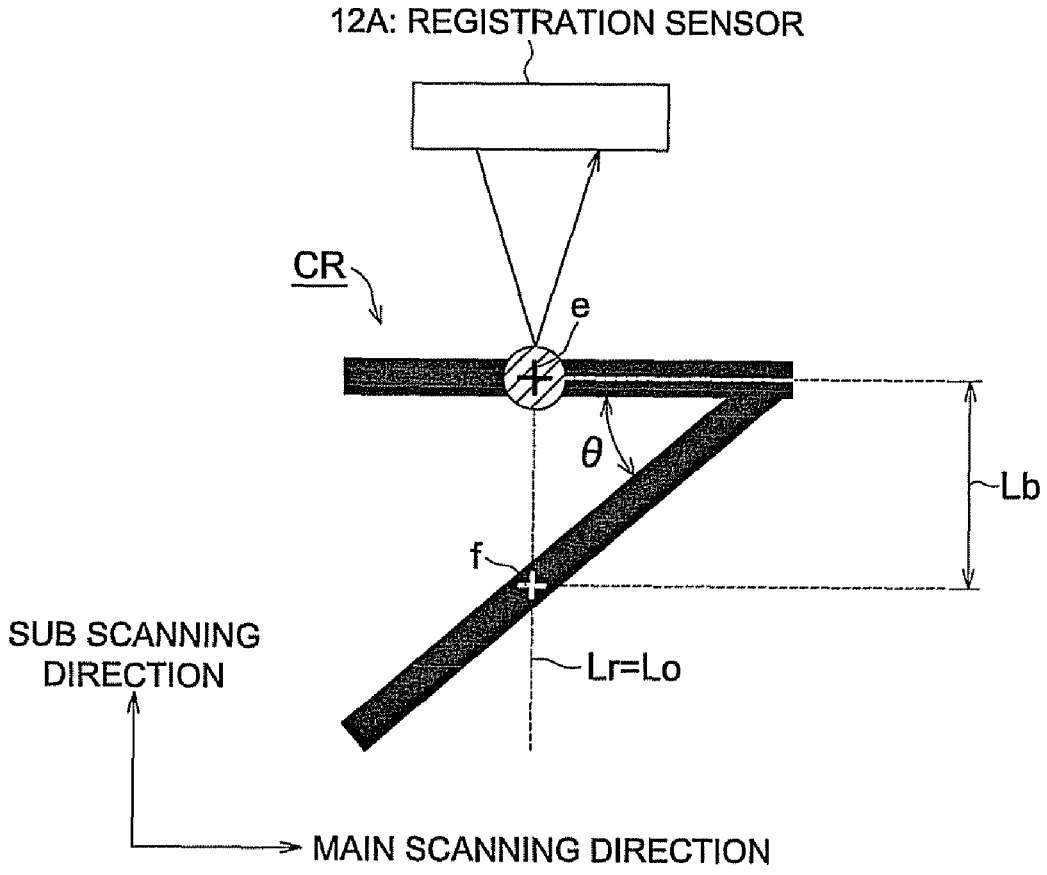
FIG. 9 is a drawing showing a relation example between the registration mark CR for color misalignment correction and the registration sensor 12A.
Figure 10:
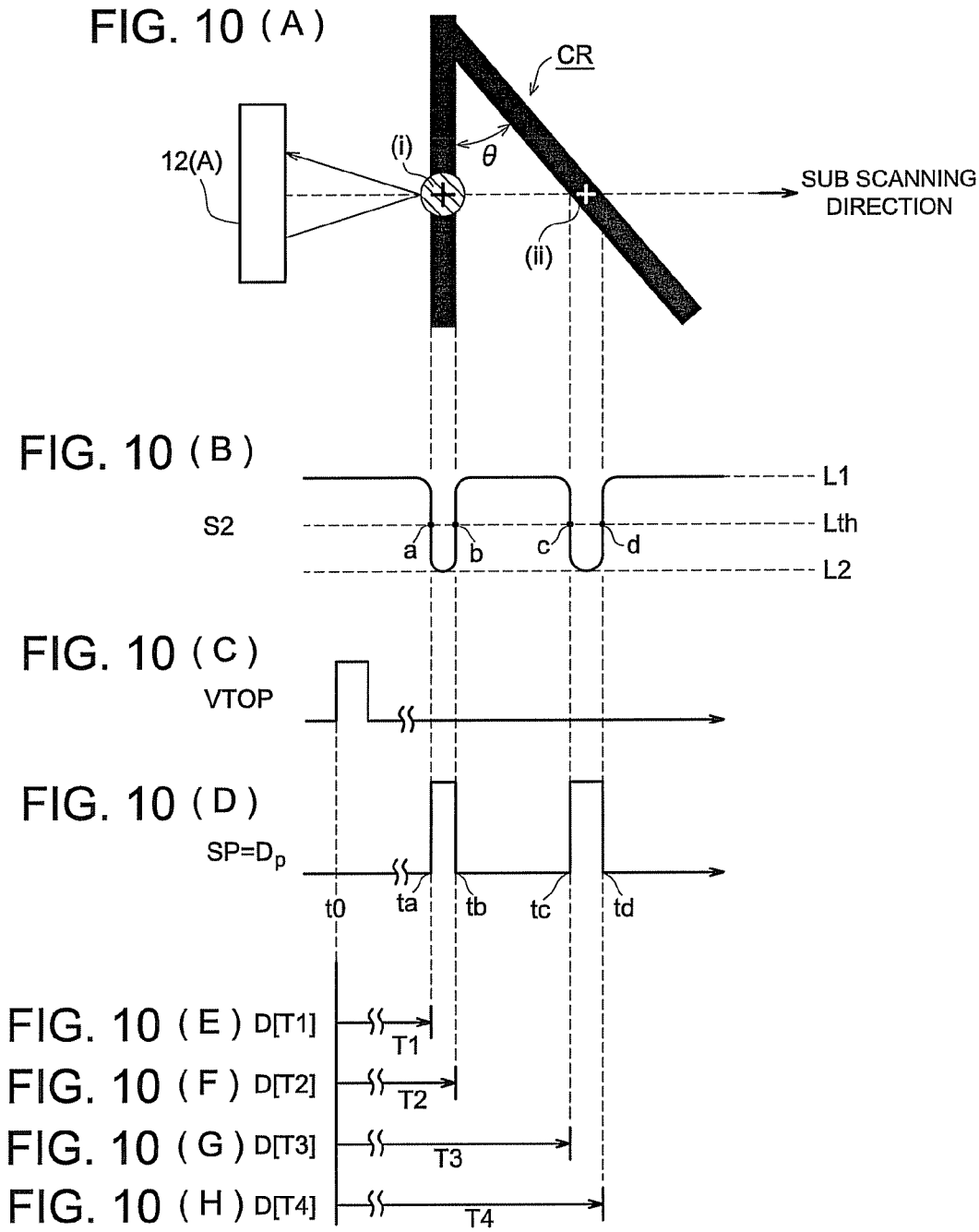
FIGS. 10(A) to 10(H) are drawings showing binary coding examples of an image detection signal S21 by the registration sensor 12A.

FIG. 9 is a drawing showing a relation example between the registration mark CR for color misalignment correction and the registration sensor 12A. The registration mark CR shown in FIG. 9 is applied in the color misalignment correction mode and is composed of the line segment parallel with the main scanning direction and the line segment at an angle of θ=45° with the main scanning direction. The registration mark CR can be used as it is as a pre-mark CP in the correction judgment mode. When the image boundary area is narrow, a pre-mark CP composed of a line segment at an angle of about θ=20° with a line segment parallel with the main scanning direction may be applied (refer to FIG. 4B).

In this example, the registration mark CR is formed in a "∠" shape. The registration mark CR is written so as to make a central point e thereof coincide with the irradiation position of the spot diameter of the registration sensor 12A. So that the registration mark CR is formed on the intermediate transfer belt 6 by the CPU 57 shown in FIG. 8, the image forming units 10Y, 10M, 10C, and 10K are controlled.

In this example, when from the central point e of the line segment parallel with the main scanning direction, an additional line parallel with the sub scanning direction is drawn and the intersection point of the line segment at an angle of 45° with the additional line is assumed as f, the length of the line segment between the points e and f is assumed as Lb. In this embodiment, from the difference in the detection time between the points e and f of the registration mark CR, the length Lb of the line segment between the points e and f is calculated, thus the position misalignment in the main scanning direction of the registration mark CR for color misalignment correction to the detection points of the registration sensors 12A and 12B can be detected.

These registration marks CR for color misalignment correction are detected by the registration sensors 12A and 12B, and the color misalignment amount of the registration mark CR of each color to the image forming position is calculated, and the image forming positions of Y, M, and C are corrected. This correction is executed to correct the image data Dy, Dm, Dc, and Dk for forming color images on the next sheet P by the image forming system I after execution of the color misalignment correction mode and superimpose precisely the color images based on the color misalignment correction.

FIGS. 10A to 10H are drawings showing binary coding examples of the image detection signal S21 by the registration sensor 12A.

The registration sensor 12A shown in FIG. 10A detects the edges of the linear part (i) and inclined part (ii), shown in the drawing, of the registration mark CR on the intermediate transfer belt 6 and outputs the image detection signal S21. In this example, the angle θ formed by the registration mark CR in a "∠" shape is 45°. The intermediate transfer belt 6 moves at a fixed linear speed in the sub scanning direction. In the registration sensor 12A, light is irradiated to the registration mark CR from a light emission device not drawn and the reflected light thereof is detected by a light receiving device. The pre-mark CP is also processed similarly, so that the explanation thereof will be omitted.

The image detection signal S21 shown in FIG. 10B is obtained from the registration sensor 12A and in the image detection signal S21, Li indicates a belt (surface) detection level. Lth indicates a threshold value for binarizing the image detection signal S21 and L2 indicates a mark detection level relating to the registration mark CR. A point a is a point when the front end edge of the linear part (i) of the registration mark is detected by the registration sensor 12A and the image detection signal S21 thereof crosses the threshold value Lth, which gives front end edge detection time ta. At the front end edge detection time ta, a first passing timing pulse signal Sp shown in FIG. 10D starts up.

A point b is a point when the rear end edge of the linear part (i) of the registration mark is detected similarly and the image detection signal S21 thereof crosses the threshold value Lth, which gives rear end edge detection time tb. At the rear end edge detection time tb, the passing timing pulse signal Sp shown in FIG. 10D shuts down.

Similarly, a point c is a point when the front end edge of the inclined part (ii) of the registration mark is detected by the registration sensor 12A and the image detection signal S21 thereof crosses the threshold value Lth, which gives front end edge detection time tc. At the front end edge detection time tc, the second passing timing pulse signal Sp shown in FIG. 10D starts up.

A point d is a point when the rear end edge of the inclined part (ii) of the registration mark is detected similarly and the image detection signal S21 thereof crosses the threshold value Lth, which gives rear end edge detection time td. At the rear end edge detection time td, the passing timing pulse signal Sp shown in FIG. 10D shuts down. The passing timing pulse signal Sp after binary coding becomes image detection data Dp. The image detection data Dp is used to calculate the misalignment amount of the writing position of each of Y, M, and C to the writing position of the black registration mark CR.

The mark width of the linear part (i) of the registration mark in the sub scanning direction, when the intermediate transfer belt 6 moves at a fixed linear speed in the sub scanning direction, is obtained on the basis of a time period T2 shown in FIG. 10F and a time period T1 shown in FIG. 10E. The time period T1, when a writing start signal (VTOP signal) starts up at time to shown in FIG. 10C, and a counter not drawn is started, thereafter the pulse number of the reference clock signal is counted, and the front end edge detection time ta comes, is obtained by the output value (time period information D [T1]) outputted from the counter.

The VTOP signal is a signal (image end signal) for permitting to write the registration mark CR on the photosensitive drums 1Y, 1M, 1C, and 1K. Similarly, the time period T2, when the counter counts furthermore the pulse number of the reference clock signal and the rear end edge detection time tb comes, is obtained by the output value (time period information D [T2]) outputted from the counter. These time period information D [T1]) and D [T2] are stored in the nonvolatile memory 14.

At time of calculation of color misalignment, from the nonvolatile memory 14, the time period information D [T1] and D [T2] are read. The control section 15 calculates the mark width of the linear part (i) of the registration mark in the sub scanning direction from "T2-T1" on the basis of the time period information D [T1]) and D [T2].

Further, the mark width of the inclined part (ii) of the registration mark in the sub scanning direction is similarly given on the basis of a time period T4 shown in FIG. 10H and a time period T3 shown in FIG. 10G. The time period T3, when the VTOP signal starts up at the time t0 shown in FIG. 10C, and the counter is started, thereafter the pulse number of the reference clock signal is counted, and the front end edge detection time tc comes, is obtained by the output value (time period information D [T3]) outputted from the counter.

Similarly, the time period T4, when the counter counts furthermore the pulse number of the reference clock signal and the rear end edge detection time tb comes, is obtained by the output value (time period information D [T4]) outputted from the counter. These time period information D [T3) and D [T4] are stored in the nonvolatile memory 14.

At time of calculation of color misalignment, from the nonvolatile memory 14, the time period information D [T3] and D [T4] are read. The control section 15 calculates the mark width of the inclined part (ii) of the registration mark in the sub scanning direction from $\sqrt{2}\cdot(T4-T3)/2$ on the basis of the time period information D [T3] and D [T4]. The information obtained after these calculations is color misalignment correction data. Further, the registration sensor 12B functions similarly, so that the explanation thereof will be omitted.

Embodiment 1

Figure 11:
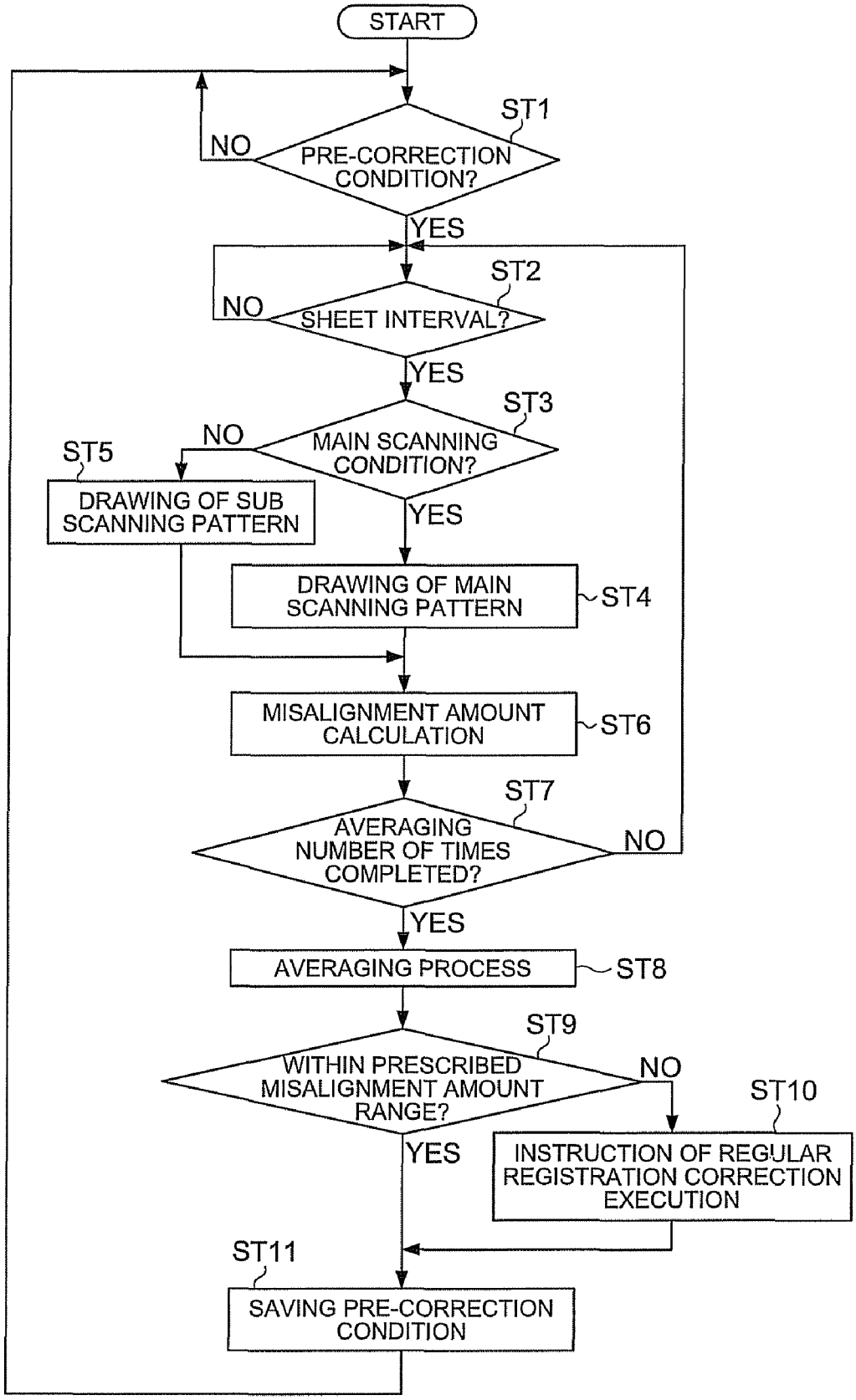
FIG. 11 is a flow chart showing a sheet interval pattern control example relating to the first embodiment.

FIG. 11 is a flow chart showing a sheet interval pattern control example relating to the first embodiment. This embodiment is executed on the assumption that the correction judgment mode is executed in the ordinary operation mode and on the base of the judgment results by the correction judgment mode, the execution time of the color misalignment correction mode is decided. In this example, the case that the color misalignment amounts calculated from the detection results of the pre-marks CP formed at sheet intervals are processed statistically, thus the results are assumed as a control amount for color misalignment correction is illustrated.

Under the control conditions thereof, at Step ST1 of the flow chart shown in FIG. 11, the CPU 57 judges whether the pre-correction condition is realized or not. Here, the pre-correction condition is referred to as a condition for executing the correction judgment mode and deciding the execution time of the color misalignment correction mode. For example, when the fixing temperature of the fixing device 17 is changed and the temperature difference Δ becomes 2° C., when the number of fed sheets reaches the prescribed number, when the image forming units 10Y, 10M, 10C, and 10K are stopped for a given period of time, or when the main power source is turned on, the CPU 57 judges that the pre-correction condition is realized. For each of the above conditions, there is a monitoring flow chart available, though the well-known technique can be applied to it, so that the explanation thereof will be omitted.

When one and/or two or more condition items aforementioned correspond to the pre-correction condition, the CPU 57 moves to Step ST2 and judges whether pre-marks CP reach at sheet intervals or not in order to execute the correction judgment mode in the ordinary operation mode. Whether pre-marks CP reach at sheet intervals or not is judged by detecting the end of flag of the input image data DIN for one page by the image processing section 70. The end of flag is a flag indicating the terminal of the image forming area for one page. In this example, an image transferred to the intermediate transfer belt 6 via the photosensitive drums 1Y, 1M, 1C, and 1K relating to the ordinary operation mode is started in writing on the basis of start-up of the signal SVV and is ended in writing at the point of time of shut-down of the signal SVV.

In the aforementioned example, when the end of flag is detected and pre-marks CP reach at sheet intervals, the CPU 57 moves to Step ST3 and branches the control according to the main scanning condition or sub scanning condition. The main scanning condition is referred to as a condition for branching the control according to the scanning form of the writing unit. In this example, the control is branched by the LPH unit 3Y and polygon mirror scanning form. The LPH unit 3Y is a unit for exposing in a batch in each line and is equal to no misalignment in the main scanning direction, so that the misalignment in the sub scanning direction may be corrected. The polygon mirror scanning form is a form for executing deflection scanning exposure for each pixel, thus misalignments in the main scanning direction and sub scanning direction may be considered, so that it is executed so as to correct misalignments in the main and sub scanning directions.

In this example, the scanning conditions such that regarding the LPH unit 3Y, the ratio of dedicated pre-mark formation for main scanning to dedicated pre-mark formation for sub scanning is set to, for example, 1:4 and regarding the polygon mirror scanning form, the ratio of dedicated pre-mark formation for main scanning to dedicated pre-mark formation for sub scanning is set to 1:1 may be included.

When such scanning conditions are set and the main scanning condition is set so that the scanning form of the writing unit is the polygon mirror scanning form, the CPU 57 moves to Step ST4 and controls the image forming section 80 so as to execute drawing of the main scanning pattern. At this time, the image forming section 80 controls the image forming units 10Y, 10M, 10C, and 10K so as to form the pre-marks CP in the "∠" shape shown in FIG. 4B in the image boundary areas IIa, IIb, - - - between the image forming areas Ia and Ib and between the image forming areas Ib and Ic as dedicated pre-marks CP for main scanning.

When the scanning form of the writing unit is the sub scanning condition which is a batch exposure system such as that of the LPH unit 3Y, the CPU 57 moves to Step ST5 and controls the image forming section 80 so as to execute drawing of the sub scanning pattern. The image forming section 80 controls the image forming units 10Y, 10M, 10C, and 10K so as to form the linear pre-marks CP of Y, M, C, and BK shown in FIG. 4A in the image boundary areas IIa, IIb, - - - between the image forming areas Ia and Ib and between the image forming areas Ib and Ic as dedicated pre-marks CP for sub scanning.

Thereafter, the CPU 57 moves to Step ST6 and calculates the color misalignment amount. At this time, the registration sensor 12A detects the sheet interval pre-mark CP and outputs the image detection signal S21 to the A-D converter 13A. The registration sensor 12B also detects the sheet interval pre-mark CP and outputs the image detection signal S22 to the A-D converter 13B. The CPU 57, on the basis of the image detection data Dp1 and Dp2 outputted from the A-D converters 13A and 13B, calculates the color misalignment amount. The color misalignment amount in this case is a control amount when the color misalignment amount is corrected by the statistical method (refer to FIGS. 9 and 10).

Thereafter, the CPU 55 moves to Step ST7 and judges whether the averaging number of times necessary for the averaging process of color misalignment amounts is completed or not. Regarding the averaging number of times, for example, an integer such as 10 times, 20 times, 50 times, or 100 times is set.

When the averaging number of times necessary for the averaging process is completed, the CPU 57 moves to Step ST8 and executes the averaging process of color misalignment amounts. In this process, for example, the mean value of color misalignment amounts of 10 times is calculated. Thereafter, the CPU 57 moves to Step ST9 and judges whether the mean value of color misalignment amounts is within the prescribed misalignment amount range or not. At this time, the CPU 57 compares the mean value of color misalignment amounts with the set upper limit misalignment amount and lower limit misalignment amount and finds whether the mean value of color misalignment amounts is included between the upper limit misalignment amount and the lower limit misalignment amount or not.

As a result, when the mean value of color misalignment amounts is not within the prescribed misalignment amount range, the CPU 57 moves to Step ST10 and to execute immediately the regular color registration correction process, instructs the "color misalignment correction mode" to the image forming section 80. The image forming apparatus 80, on the basis of the instruction of the color misalignment correction mode, interrupts the job and executes the regular color registration correction process (refer to FIG. 6). Thereafter, the CPU 57 moves to Step ST11.

At Step ST9, when the mean value of color misalignment amounts is within the prescribed misalignment amount range, the CPU 57 moves to Step ST11 and stores the pre-correction condition. In this example, as a pre-correction condition, for example, the data indicating the mean value of color misalignment amounts at the point of time when the number of fed sheets reaches the prescribed number is saved in the nonvolatile memory 14. The concerned data is used to calculate the next execution time of the color misalignment correction mode. For example, the CPU 57 compares relatively the preceding color misalignment amount with the present color misalignment amount and when they are beyond the preset range, even if it is not the predetermined color registration correction timing, executes the color misalignment correction mode, and even if it is designed color registration correction timing, if it is within the preset range, can control so as not to execute the color misalignment correction mode.

As mentioned above, according to the color printer 100 relating to the first embodiment, the CPU 57 for controlling the image forming section 80 so as to execute the correction judgment mode in the ordinary operation mode is provided. In the correction judgment mode, an operation of writing the pre-mark CP for color misalignment correction in the image boundary areas Ia, IIb, - - - held between the image forming area Ia on the concerned page formed by the intermediate transfer belt 6 by the image forming section 80 and the image forming area Ib on the next page, detecting the concerned pre-mark CP, processing statistically the detection results of the pre-mark CP, and discriminating whether or not to execute the correction misalignment correction mode is performed.

Therefore, even if the color misalignment correction time does not come, the correction misalignment correction mode can be executed. Inversely, even if the color misalignment correction time comes, as a result of the correction judgment mode, when "No need to execute color misalignment correction mode" is judged, the CPU 57 can control the image forming section 80 so as not to execute the color misalignment correction mode at the present time. Therefore, the color misalignment correction timing accuracy can be improved compared with that of the conventional system, so that compared with the periodic execution of the color misalignment correction mode, the image quality can be improved. Moreover, as a whole, the toner consumption can be reduced. Further, for the fixed execution timing of the color misalignment correction mode, the execution timing is made correctable fluidly, so that compared with the conventional system, the execution timing under an accurate control condition can be decided.

Embodiment 2

Figure 12:
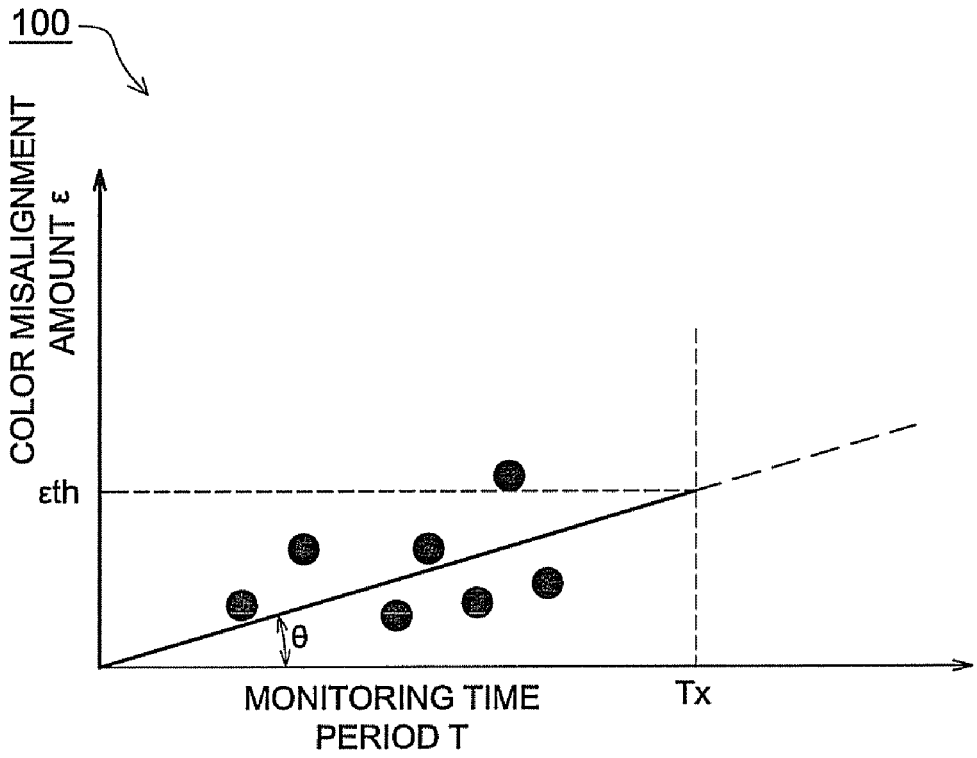
FIG. 12 is a graph showing a relation example between the color misalignment amount and the monitoring time period relating to the color printer 100 of the second embodiment.

FIG. 12 is a graph showing a relation example between the color misalignment amount and the monitoring time period relating to the color printer 100 of the second embodiment.

In this example, the detection results of the pre-mark CP are processed statistically, and the trend of the color misalignment amount of the pre-mark CP is predicted, and the color misalignment correction amount before the incoming of the execution time of the color misalignment correction mode is calculated. For example, two kinds of pre-marks CP such as an dedicated pattern for main scanning and an dedicated pattern for sub scanning are formed in the image boundary area IIa (at sheet intervals), and from the color misalignment amount (measured value) obtained by mark detection, weights a, b, and c are added to the appearance prediction formula (multiple regression formula) of each pre-mark CP, and a sub scanning misalignment amount Vx, a main scanning misalignment amount Hx, and a skew misalignment amount Sx are obtained by calculation.

In the graph shown in FIG. 12, the ordinate axis indicates a color misalignment amount $\epsilon$ as a target variable, which is a measured value of the color misalignment amount obtained by mark detection. The abscissa axis indicates a monitoring time period T as an explanation variable, which is the time counted from the time at which the color misalignment correction mode is executed to the next correction time.

The color misalignment amount $\epsilon$ and monitoring time period T have a correlation. In the drawing, $\epsilon$th indicates a threshold value of the color misalignment amount and the monitoring time period T is a standard when deciding whether correction time Tx comes or not. Each dot shown in the graph in FIG. 12 indicates a measured value of the color misalignment amount at an optional monitoring time period Ti (i=1 to n) and the measured values are dispersed. Further, the straight line (primary function) indicates a single regression formula for obtaining a sub scanning misalignment amount V, a main scanning misalignment amount H, and a skew misalignment amount S from the color misalignment amount (measured value). In this example, assuming the inclination of the single regression formula as $\alpha$ and the predicted value of the color misalignment amount $\epsilon$ at the color misalignment correction time Tx as YAx, $YAx=\alpha \cdot Tx$ is held. Assuming the inclination of the single regression formula as $\theta$, $\theta=\tan^{-1}(\epsilon th/Tx)$ is held. Therefore, the predicted value YAx of the color misalignment amount $\epsilon$ at the color misalignment correction time Tx can be predicted.

In this example, the CPU 57 of the control section 15 decides the multiple regression formula corresponding to the straight line shown in the graph in FIG. 12, calculates the sub scanning misalignment amount V, main scanning misalignment amount H, and skew misalignment amount S, and predicts the color misalignment correction amount at the monitoring time period Ti (i=1 to n). Here, the predicted value (control value) of the color misalignment amount at the monitoring time period Ti is assumed as YF1, and the predicted value of the color misalignment amount at the monitoring time period T2 is assumed as YF2, and the predicted value of the color misalignment amount at the monitoring time period T3 is assumed as YF3, and similarly, the predicted value of the color misalignment amount at the monitoring time period Tn is assumed as YFn. The relationship between the predicted value and the measured value is stored whenever necessary in the nonvolatile memory 14. The reason is that from few measured values obtained from sheet interval pre-mark detection, the predicted value (control value) is decided (linear prediction method).

Here, the actual measured value of the color misalignment amount at the monitoring time period T1 is assumed as YA1, and the measured value of the color misalignment amount at the monitoring time period T2 is assumed as YA2, and the measured value of the color misalignment amount at the monitoring time period T3 is assumed as YA3, and similarly, the measured value of the color misalignment amount at the monitoring time period Tn is assumed as YAn. And, assuming the error between the predicted value YFx (target variable) of the color misalignment amount at each monitoring time period Tx and the measured value YAx as Ex, Formula (1) composed of n error formulas indicated below is obtained.

$$\begin{aligned} E1 &= YF1 - YA1 \\ E2 &= YF2 - YA2 \\ E3 &= YF3 - YA3 \\ &\vdots \\ En &= YFn - YAn \end{aligned} \tag{1}$$

And, when the sub scanning misalignment amount Vx, main scanning misalignment amount Hx, and skew misalignment amount Sx are used as explanation variables at each monitoring time period Tx and the weighting factors (partial regression coefficient) are assumed as a, b, and c, the predicted value YFx is expressed by Formula (2) composed of n linear multiple regression formulas indicated below.

$$\begin{aligned} YF1 &= aV1+bH1+cS1 \\ YF2 &= aV2+bH2+cS2 \\ YF3 &= aV3+bH3+cS3 \\ &\cdot \\ &\cdot \\ &\cdot \\ YFn &= aVn+bHn+cSn \end{aligned} \tag{2}$$

Here, when the weighting coefficients a, b, and c are decided by the method of least squares so as to minimize the sum of squares of all the errors E1, E2, E3, - - - , and En shown in Formula (1), from the multiple regression formula of Formula (2), the sub scanning misalignment amount Vx, main scanning misalignment amount Hx, and skew misalignment amount Sx can be obtained. Further, regarding the weighting factors a, b, and c, initially, the weighting factors under the fixing condition are inputted and so as to keep the errors of Formula (1) at the minimum, the weighting factors a, b, and c are changed (updated) whenever necessary (learning function). By this learning function, the machine intrinsic system error is reflected on the weighting factors and the color misalignment correction amount can be predicted optimally.

When this multiple regression formula (2) is decided, the sub scanning misalignment amount Vx, main scanning misalignment amount Hx, and skew misalignment amount Sx at an optional monitoring time period Tx can be predicted. For example, if the measured value YA1 is substituted for the linear multiple regression formula of the predicted value YF1 at the monitoring time period T1 shown in Formula (2) and for the error formula of Formula (1) corresponding to it, as one of the predicted values, a sub scanning misalignment amount V1, a main scanning misalignment amount H1, and a skew misalignment amount S1 can be obtained. By doing this, on the way to the execution time of the color misalignment correction mode, the CPU 57 can execute the color misalignment correction mode based on the color misalignment correction amount.

Figure 13:
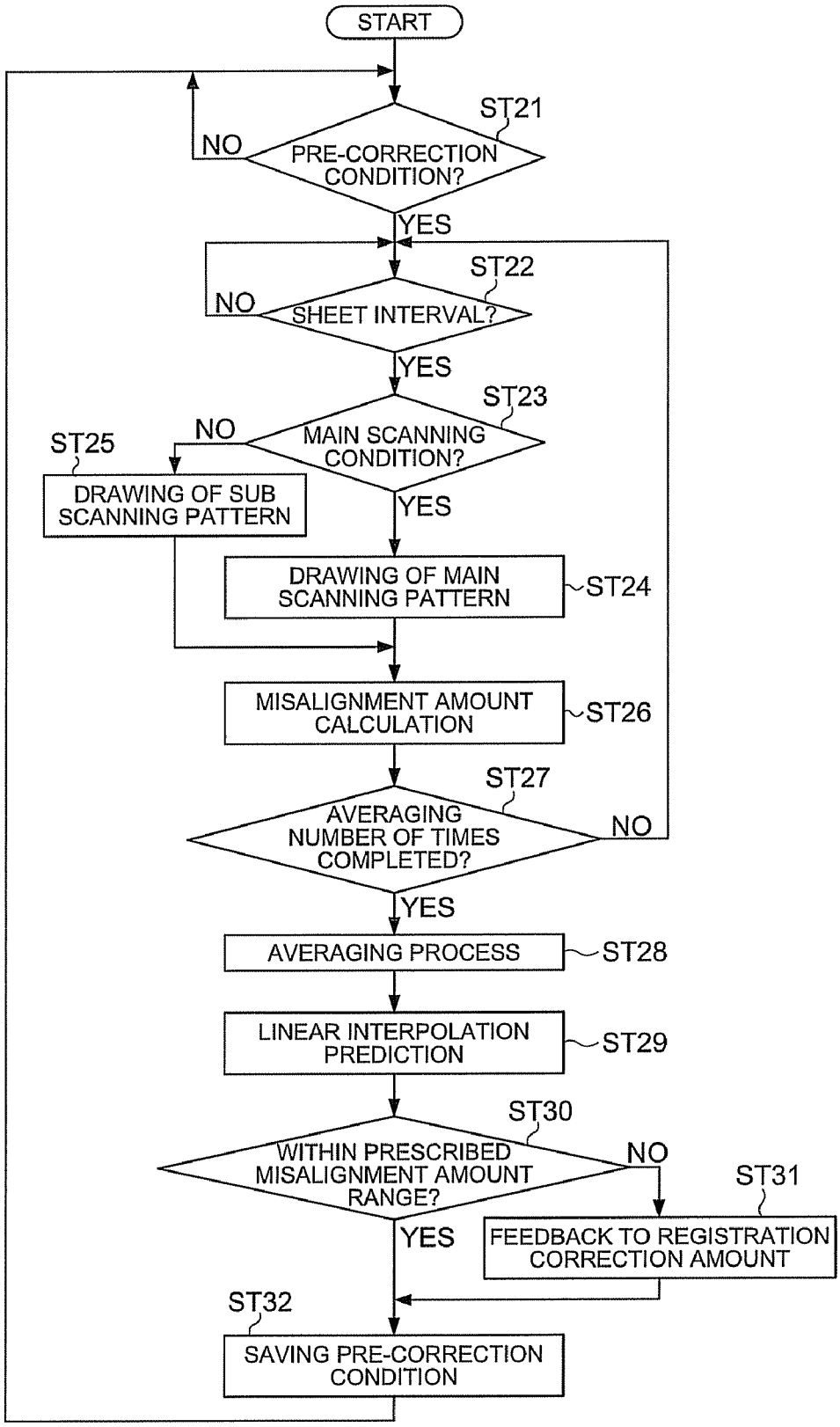
FIG. 13 is a flow chart showing a sheet interval pattern correction control example relating to the second embodiment.

FIG. 13 is a flow chart showing a sheet interval pattern correction control example relating to the second embodiment.

In this embodiment, after the averaging process of the color misalignment amount explained in the first embodiment, the CPU 57 executes the linear interpolation process and on the way to the execution time of the color misalignment correction mode, can execute the color misalignment correction mode based on the color misalignment correction amount.

Under the control conditions thereof, at Step ST21 of the flow chart shown in FIG. 13, similarly to the first embodiment, the CPU 57 judge whether the pre-correction condition is realized or not. For example, when the fixing temperature of the fixing device 17 is changed and the temperature difference Δ becomes 2° C., when the number of fed sheets reaches the prescribed number, when the image forming units 10Y, 10M, 10C, and 10K are stopped for a given period of time, or when the main power source is turned on, the CPU 57 judges that the pre-correction condition is realized.

Regarding the aforementioned pre-correction condition, when one and/or two or more condition items correspond to the pre-correction condition, the CPU 57 moves to Step ST22 and judges whether pre-marks CP reach sheet intervals or not in order to execute the correction judgment mode in the ordinary operation mode. Whether pre-marks CP reach sheet intervals or not is judged by detecting the end of flag of the input image data DIN for one page.

In the aforementioned example, when the end of flag is detected and pre-marks CP reach sheet intervals, the CPU 57 moves to Step ST23 and similarly to the first embodiment, branches the control according to the main scanning condition or sub scanning condition. In this example, when the scanning form of the writing unit is the main scanning condition, the CPU 57 moves to Step ST24 and controls the image forming section 80 so as to execute drawing of the main scanning pattern. At this time, the image forming section 80 controls the image forming units 10Y, 10M, 10C, and 10K so as to form the pre-marks CP in the "∠" shape shown in FIG. 4B in the image boundary areas IIa, IIb, - - - between the image forming areas Ia and Ib and between the image forming areas Ib and Ic as dedicated pre-marks CP for main scanning.

When the scanning form of the writing unit is the sub scanning condition, the CPU 57 moves to Step ST25 and controls the image forming section 80 so as to execute drawing of the sub scanning pattern. The image forming section 80 controls the image forming units 10Y, 10M, 10C, and 10K so as to form the linear pre-marks CP of Y, M, C, and BK shown in FIG. 4A in the image boundary areas IIa, IIb, - - - between the image forming areas Ia and Ib and between the image forming areas Ib and Ic as dedicated pre-marks CP for sub scanning.

Thereafter, the CPU 57 moves to Step ST26 and calculates the color misalignment amount. At this time, the registration sensor 12A detects the sheet interval pre-mark CP and outputs the image detection signal S21 to the A-D converter 13A. The registration sensor 12B also detects the sheet interval pre-mark CP and outputs the image detection signal S22 to the A-D converter 13B. The CPU 57, on the basis of the image detection data Dp1 and Dp2 outputted from the A-D converters 13A and 13B, calculates the color misalignment amount. The color misalignment amount in this case is a control amount when the color misalignment amount is corrected by the statistical method (refer to FIGS. 9 and 10).

Thereafter, the CPU 55 moves to Step ST27 and judges whether the averaging number of times necessary for the averaging process of color misalignment amounts is completed or not. Regarding the averaging number of times, for example, an integer such as 10 times, 20 times, 50 times, or 100 times is set. When the averaging number of times necessary for the averaging process is completed, the CPU 57 moves to Step ST28 and executes the averaging process of color misalignment amounts. In this process, similarly to the first embodiment, the mean value of color misalignment amounts of 10 times is calculated.

Thereafter, at Step ST29, the CPU 57 executed the linear interpolation prediction. At this time, the CPU 57 decides the linear multiple regression formula shown in Formula (2), calculates the sub scanning misalignment amount V, main scanning misalignment amount H, and skew misalignment amount S, and predicts the color misalignment correction amount at the monitoring time period Ti (i=1 to n). Therefore, on the way to the execution time of the color misalignment correction mode, the CPU 57 can execute the color misalignment correction mode based on the color misalignment correction amount.

Thereafter, similarly to the first embodiment, the CPU 57 moves to Step ST30 and judges whether the mean value of color misalignment amounts is within the prescribed misalignment amount range or not. At this time, the CPU 57 compares the mean value of color misalignment amounts with the set upper limit misalignment amount and lower limit misalignment amount and finds whether the mean value of color misalignment amounts is included between the upper limit misalignment amount and the lower limit misalignment amount or not.

As a result, when the mean value of color misalignment amounts is not within the prescribed misalignment amount range, the CPU 57 moves to Step ST31 and to execute immediately the regular color registration correction process, instructs the "color misalignment correction mode" to the image forming section 80. The image forming apparatus 80, on the basis of the instruction of the color misalignment correction mode, interrupts the job and executes the regular color registration correction process (refer to FIG. 6). Thereafter, the CPU 57 moves to Step ST31.

At Step ST 30, when the mean value of color misalignment amounts is within the prescribed misalignment amount range, the CPU 57 moves to Step ST32 and stores the pre-correction condition. In this example, as a pre-correction condition, for example, the data indicating the mean value of color misalignment amounts at the point of time when the number of fed sheets reaches the prescribed number is stored in the nonvolatile memory 14. The concerned data is used to calculate the next execution time of the color misalignment correction mode.

As mentioned above, according to the color printer 100 relating to the second embodiment, the control section 15 processes statistically the detection results of the pre-mark CP, predicts the trend of the color misalignment amount of the pre-mark CP, calculates the color misalignment correction amount before the incoming of the execution time of the color misalignment correction mode, and on the way to the execution time of the color misalignment correction mode, executes the color misalignment correction mode based on the color misalignment correction amount.

Further as a preferable embodiment, at Step of ST 29, the control section compares the predicted trend of the color misalignment amount of the pre-mark CP with a prescribed threshold value, calculates a timing when a color misalignment amount in the trend reaches the threshold value, and determines the timing as the execution timing of the color misalignment correction mode.

Further, by calculating the color misalignment correction amount at the execution timing in addition to predicting the execution timing, and by executing the color misalignment correction using the calculated correction amount, it can be omitted to execute the color misalignment correction mode that needs to stop the usual image forming job.

Therefore, compared with the periodic execution of the color misalignment correction mode, the image quality can be improved. Moreover, as a whole, the toner consumption can be reduced.

Embodiment 3

Figure 14:
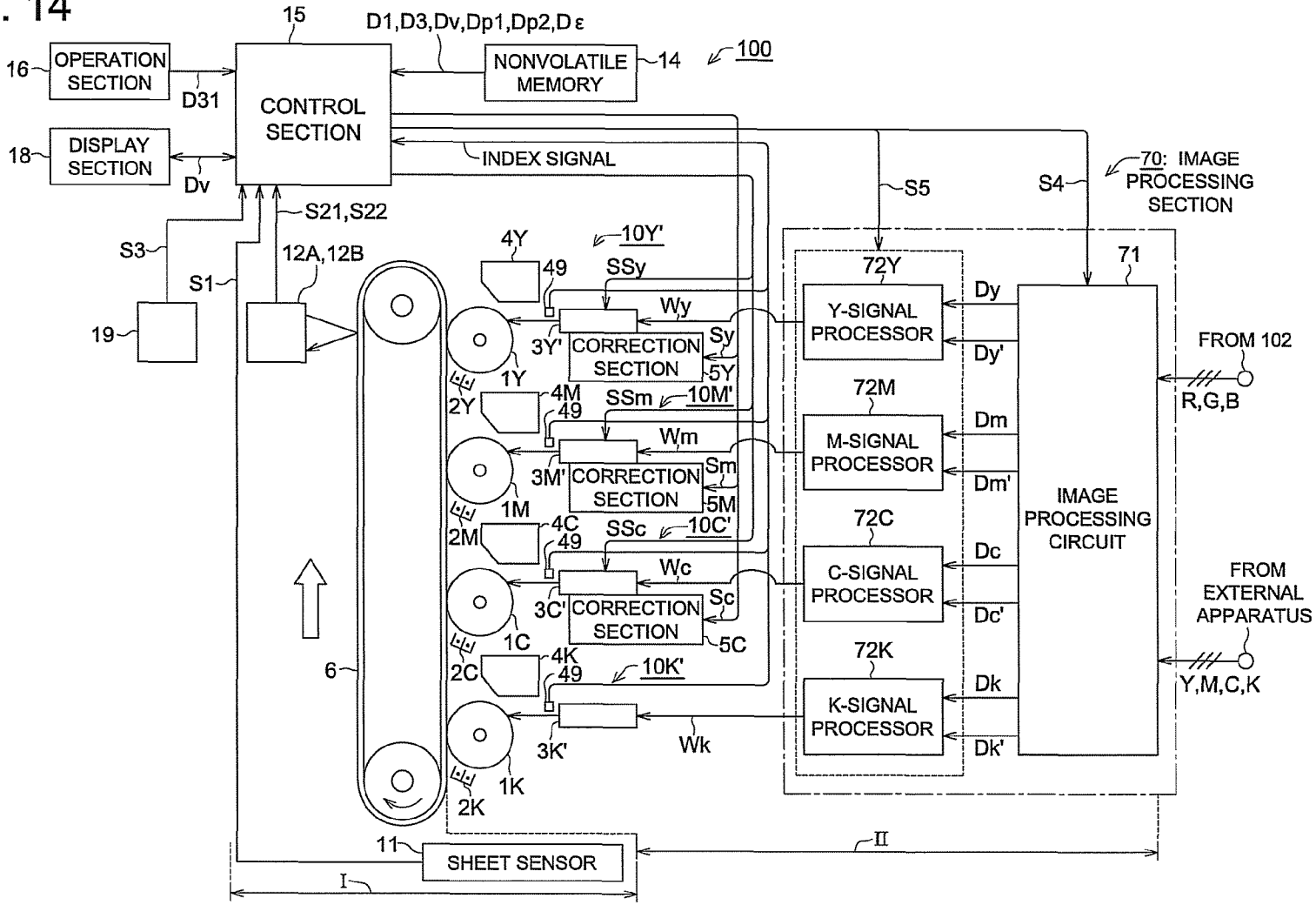
FIG. 14 is a block diagram showing a constitution example of the image transfer system I and image forming system II of a color printer 200 of the third embodiment.

FIG. 14 is a block diagram showing a constitution example of the image transfer system I and image forming system II of the color printer 200 of the third embodiment.

The color printer 200 shown in FIG. 14, instead of the LPH unit of the first embodiment, has laser writing units 3Y', 3K', 3C', and 3K' of a polygon mirror scanning form in the image forming section 80', has a light source for deflection-scanning a light beam in the main scanning direction of the intermediate transfer belt 6, and exposes image information for each pixel onto the intermediate transfer belt 6.

FIG. 14 is a block diagram showing a constitution example of the image transfer system I and image forming system II of the color printer 200. The color printer 200 shown in FIG. 14 comprises the image transfer system I composed of the processing system including the intermediate transfer belt 6, sheet width sensor 11, and registration sensors 12A and 12B and the image forming system II composed of image forming units 10Y', 10M', 10C', and 10K'.

In FIG. 14, the parts having the same names and same numerals as those of the first embodiment have the same functions, so that the explanation thereof will be omitted.

The Y-signal processor 72Y selects the image data Dy or image data Dy' on the basis of the writing selection signal S5 and outputs the image data Dy or image data Dy' to the laser writing unit 3Y'. The laser writing unit 3Y' detects the irradiation timing of a laser beam for yellow and outputs a laser detection signal (hereinafter, referred to as a Y-INDEX signal).

The M-signal processor 72M selects the image data Dm or image data Dm' on the basis of the writing selection signal S5 and outputs the image data Dm or image data Dm' to the laser writing unit 3M'. The laser writing unit 3M' detects the irradiation timing of a laser beam for magenta and outputs a laser detection signal (hereinafter, referred to as an M-INDEX signal).

The C-signal processor 72C selects the image data Dc or image data Dc' on the basis of the writing selection signal S5 and outputs the image data Dc or image data Dc' to the laser writing unit 3C'. The laser writing unit 3C' detects the irradiation timing of a laser beam for cyan and outputs a laser detection signal (hereinafter, referred to as a C-INDEX signal).

The K-signal processor 72K selects the image data Dk or image data Dk' on the basis of the writing selection signal S5 and outputs the image data Dk or image data Dk' to the laser writing unit 3K'. The laser writing unit 3K' detects the irradiation timing of a laser beam for black and outputs a laser detection signal (hereinafter, referred to as a K-INDEX signal). The writing selection signal S5 is outputted from the control section 15 to the Y- to K-signal processors 72Y to 72K.

In this example, to the laser writing unit 3Y' for yellow, a correction section 5Y is attached and on the basis of a unit position correction signal Sy from the control section 15, adjusts the inclination of the horizontal position of the concerned writing unit 3Y. Similarly, to the laser writing unit 3M' for magenta, a correction section 5M is attached and on the basis of a unit position correction signal Sm from the control section 15, adjusts the inclination of the horizontal position of the concerned writing unit 3M. To the laser writing unit 3C' for cyan, a correction section 5C is attached and on the basis of a unit position correction signal Sc from the control section 15, adjusts the inclination of the horizontal position of the concerned writing unit 3C (partial lateral magnification correction process).

In this example, the calculation of the color misalignment amount is based on the black registration mark CR. The reason is to adjust the writing position of a color image of Y, M, or C so as to coincide with the writing position of BK. For example, regarding the yellow writing position adjustment, the control section 15 detects the writing position of the black registration mark CR and the writing position of the yellow registration mark CR and from the misalignment amount between the writing position of the yellow registration mark CR and the writing position of the black registration mark CR, calculates the correction amount thereof. Similarly, regarding the magenta or cyan writing position adjustment, the control section 15 detects the misalignment amount between the writing position of the black registration mark CR and the writing position of the magenta or cyan registration mark CR and from the misalignment amount, calculates the correction amount of each color. Thereafter, the image forming positions of Y, M, and C are adjusted.

Figure 15:
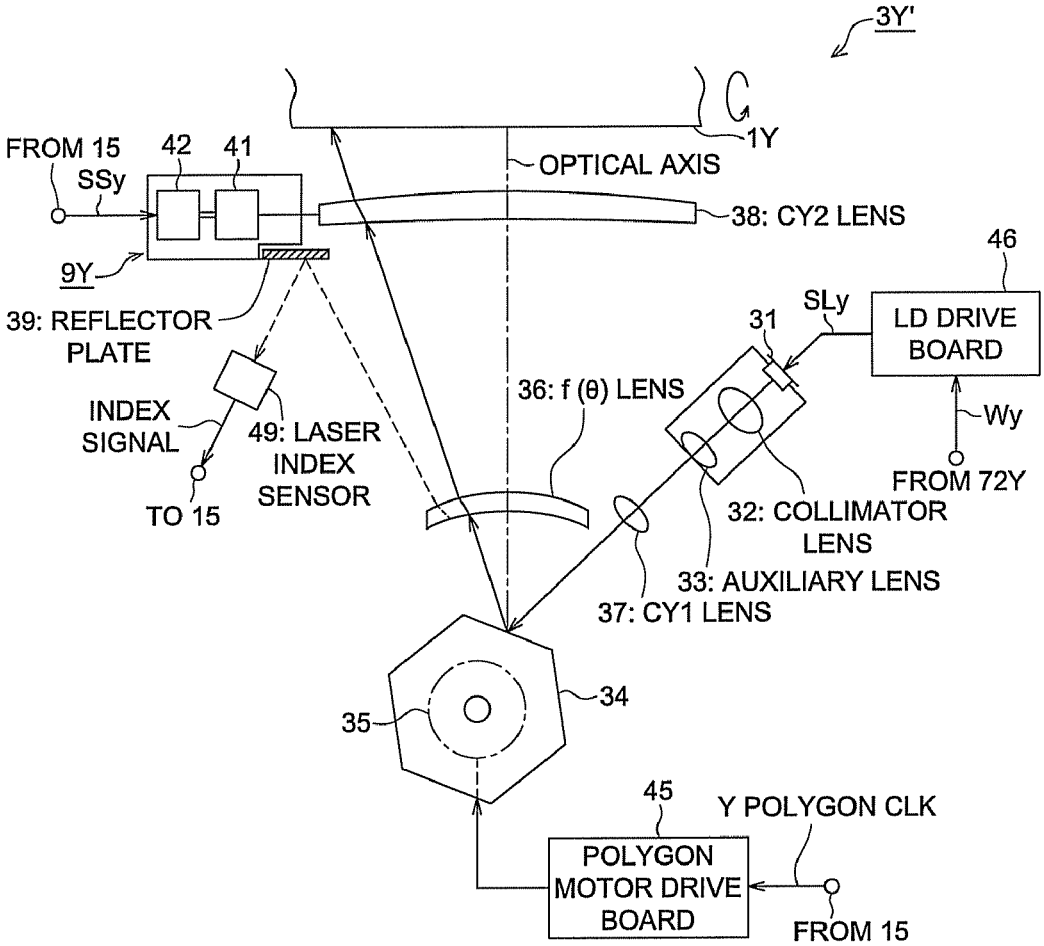
FIG. 15 is a conceptual diagram showing a constitution example of a laser writing unit 3Y' for yellow and a skew adjustment section 9Y thereof.
Figure 16:
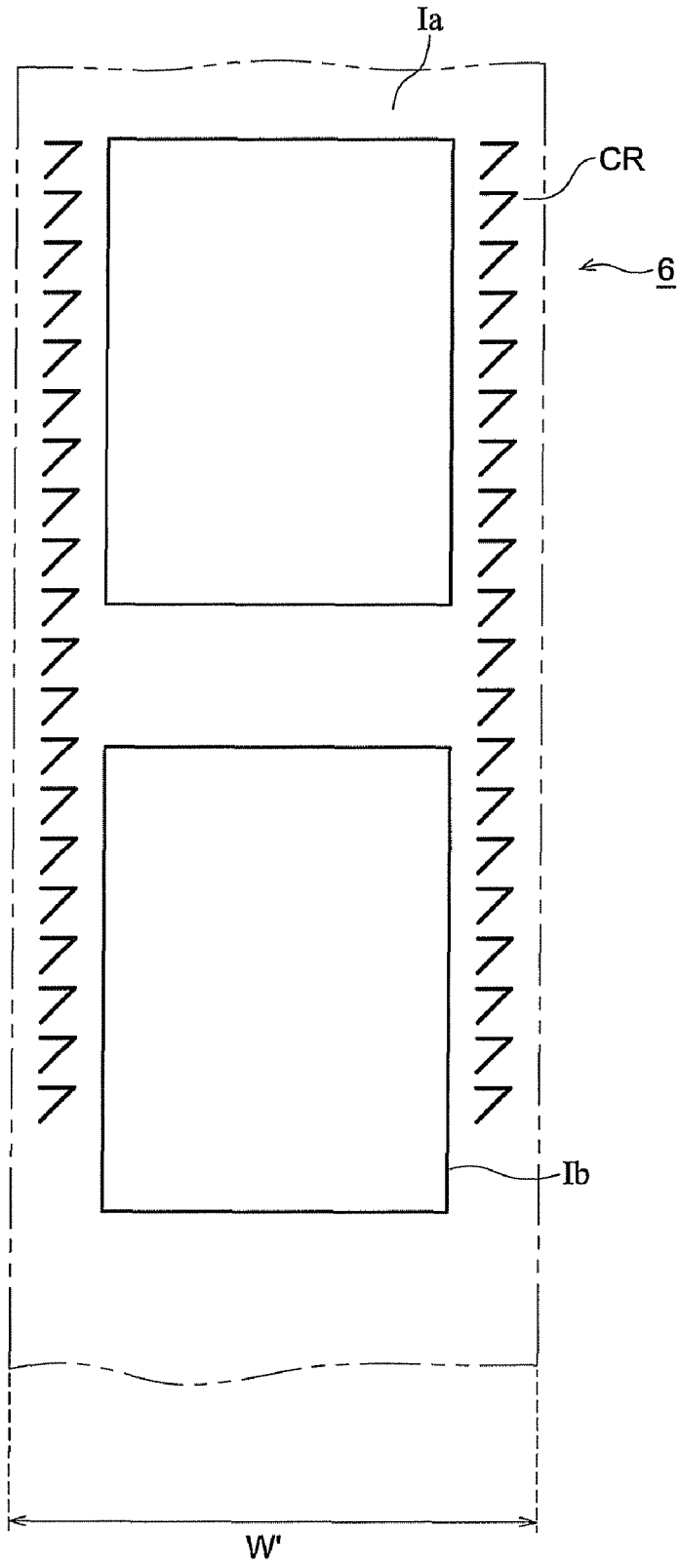
FIG. 16 is a drawing showing an outside-image pattern detection example.

FIG. 15 is a conceptual diagram showing a constitution example of the laser writing unit 3Y' for yellow and the skew adjustment section 9Y thereof. The laser writing unit 3Y' for yellow shown in FIG. 15 includes a semiconductor laser beam source 31, a collimator lens 32, an auxiliary lens 33, a polygon mirror 34, a polygon motor 35, an f(θ) lens 36, a CY1 lens 37 for mirror surface image formation, a CY2 lens 38 for drum surface image formation, a reflector plate 39, a polygon motor drive board 45, and an LD drive board 46.

The semiconductor laser beam source 31 is connected to the LT drive board 46 for yellow. To the LD drive board 46, the laser writing data Wy from the laser writing unit 3Y' is supplied. When the color misalignment composite correction mode is selected, the laser writing data Wy=image data Dy and image data Dy' are outputted to the laser writing unit 3Y'. When the color misalignment correction mode is selected, the laser writing data Wy=image data Dy' is outputted to the laser writing unit 3Y'. In the LD drive board 46, the laser writing data Wy is PWM-modulated and a laser drive signal SLy with a predetermined pulse width after PWM modulation is outputted to the semiconductor laser beam source 31. In the semiconductor laser beam source 31, a laser beam is emitted on the basis of the laser drive signal SLy for yellow. The laser beam emitted from the semiconductor laser beam source 31 is reformed to a predetermined light beam by the collimator lens 32, auxiliary lens 33, and CY1 lens 37.

The light beam is deflected in the main scanning direction by the polygon mirror 34. For example, the polygon mirror 34 is driven by the polygon motor 35. To the polygon motor 35, the polygon drive board 45 is connected and to the polygon drive board 45 from the control section 15 aforementioned, a yellow polygon clock is supplied. The polygon drive board 45, on the basis of the yellow polygon clock, rotates the polygon motor 35 at a predetermined rotational speed. The light beam deflected by the polygon mirror 34 is imaged toward the photosensitive drum 1Y by the f(θ) lens 36 and CY2 lens 38. By this operation, in the correction judgment mode, on the intermediate transfer belt 6, via the photosensitive drum 1Y, the pre-mark CP for color misalignment correction is formed in the image boundary area IIa (refer to FIGS. 4A and 4B).

In the laser writing unit 3Y', the skew adjustment section 9Y is installed. The skew adjustment section 9Y is attached to the main unit. In the main unit, the reflector plate 39 is installed and at the opposite position of the reflector plate 39, a laser index sensor 49 is attached. The laser index sensor 49 detects a light beam deflected by the polygon mirror 34 and outputs the Y-INDEX signal to the control section 15.

The skew adjustment section 9Y has an adjustment gear unit 41 and an adjustment motor 42. To the adjustment gear unit 41, the CY2 lens 38 is attached. The adjustment gear unit 41 is attached movably to the CY2 lens 38. The adjustment motor 42 moves and adjusts vertically the adjustment gear unit 41 on the basis of a skew adjustment signal SSy. Further, for constitution examples of the laser writing units 3M', 3C', and 3K' for the other colors and skew adjustment section thereof, the explanation will be omitted.

In this example, the calculation of the color misalignment amount is based on the black registration mark CR. The reason is to adjust the writing position of a color image of Y, M, or C so as to coincide with the writing position of BK. The correction processing contents are composed of, for example, the following five items i to v. Among the correction processing contents, i to iii are realized by correcting image data and iv and v are used to drive the motor 42, actually drives the laser writing units 3Y', 3M', 3C', and 3K', thereby adjust.

i. Main Scanning Correction Process

The process is a correction of aligning the writing positions of color images of Y, M, C, and BK in the main scanning direction. For example, regarding the correction of the yellow laser writing position, from the image detection data Dp1 and Dp2 of the black registration mark CR and the image detection data Dp1 and Dp2 of the yellow registration mark CR, the position misalignment amount of yellow in the main scanning direction to black is obtained and from the position misalignment amount obtained here, the correction amount therefor is calculated. On the basis of the correction amount, the writing timing of each of Y, M, and C in the main scanning direction is adjusted, thus the writing position of black is aligned with the writing positions of Y, M, and C.

ii. Sub Scanning Correction Process

The process is a correction of aligning the writing positions of color images of Y, M, C, and BK in the sub scanning direction. For example, regarding the correction of the yellow writing position, from the image detection data Dp1 and Dp2 of the black registration mark CR and the image detection data Dp1 and Dp2 of the yellow registration mark CR, the position misalignment amount of yellow in the sub scanning direction to black is obtained and from the position misalignment amount obtained here, the correction amount therefor is calculated. On the basis of the correction amount, the writing timing of each of Y, M, and C in the sub scanning direction is adjusted, thus the writing position of black is aligned with the writing positions of Y, M, and C.

iii. Total Lateral Magnification Correction Process

The process is a correction of aligning the overall image forming position of color images of Y, M, C, and BK. For example, the cycle of an image block signal is adjusted, and the laser emission timing is adjusted, and on the basis of the adjustments, the total lateral magnification misalignment amount is corrected.

iv. Partial Lateral Magnification Correction Process

The process is a correction of adjusting the inclination of the horizontal position of each of the laser writing units 3Y', 3M', 3C', and 3K'. For example, one side of the laser writing unit 3Y' in the horizontal direction is fixed to the main unit, and the other side thereof is made movable, and at the yellow correction section 5Y shown in FIG. 14, on the basis of the position correction signal Sy, the adjustment gear unit 41 is driven by rotating a motor not drawn, and the inclination of the laser writing unit 3Y' in the direction of X-Y (horizontal) is adjusted. The reason is to adjust the inclination of the horizontal position of the laser writing unit 3Y' to the photosensitive drum 1Y. Also in the other image forming units 10M' and 10C', the similar process is performed.

v. Skew Correction Process

The process is a correction of adjusting the inclination of the vertical position of the CY2 lens 38 in each of the laser writing units 3Y', 3M', 3C', and 3K'. For example, one side of the CY2 lens 38 is supported and fixed to the laser writing unit 3Y', and the other side thereof is made movable vertically, and at the skew adjustment section 9Y for yellow shown in FIG. 15, the motor 42 drives the adjustment gear unit 41 on the basis of the skew adjustment signal SSy, and the CY2 is moved and adjusted vertically. The reason is to adjust the inclination of the vertical position of the CY2 lens 38 to the photosensitive drum 1Y. Also in the other image forming units 10M' and 10C', the similar process is performed. Further, for an operation example of the color printer 200 at time of prediction of the execution time of the color misalignment correction mode, FIG. 12 and the flow chart shown in FIG. 13 may be referred to.

As mentioned above, the color printer 200 of the third embodiment has the laser writing units 3Y', 3M', 3C', and 3K' for exposing the image information for each pixel onto the intermediate transfer belt 6 and on the basis of the pre-mark CP written by a light beam deflected and scanned in the main scanning direction, the trend of the color misalignment amount can be predicted.

Moreover, instead of the outside-image registration correction of the conventional system, outside-image registration correction at sheet intervals is executed. Furthermore, before execution of the regular color registration correction process (color misalignment correction mode), even in the ordinary operation mode, the correction judgment mode using the pre-mark CP is executed, thus the execution time of the color misalignment correction mode is decided, so that even in the polygon mirror scanning form, excessive time and toner are not consumed, and the color misalignment correction mode can be executed at optimum timing. Further, the execution interval of the color misalignment correction mode is not periodic according to the color misalignment amount.

According to the color image forming apparatus and image forming method of the embodiments, the control section for executing the color misalignment correction control on the basis of the image detection information outputted by detection of an image for color misalignment correction is provided, executes the correction judgment mode, and executes the color misalignment correction mode on the basis of the judgment results in the concerned correction judgment mode.

By use of this constitution, even if the color misalignment correction time does not come, the color misalignment correction mode can be executed. Inversely, even if the color misalignment correction time comes, as a result of the correction judgment mode, when "No need to execute color misalignment correction mode" is judged, the control section can control the image forming section so as not to execute the color misalignment correction mode at the present time. Therefore, the color misalignment correction timing accuracy can be improved compared with that of the conventional system, so that compared with the periodic execution of the color misalignment correction mode, the image quality can be improved. Moreover, as a whole, the toner consumption can be reduced.

The color image forming apparatus of the embodiments has the image forming section for forming a pre-selected image for color misalignment correction on the image carrier, thereby at time of execution of the correction judgment mode, can analyze the color misalignment amount in the main scanning direction by an dedicated image for main scanning and can analyze the color misalignment amount in the sub scanning direction by an dedicated image for sub scanning. Further, the color image forming apparatus can analyze the color misalignment amounts in the main scanning and sub scanning directions by a composite image thereof.

The color image forming apparatus of the embodiments has the control section for monitoring whether the execution time of the color misalignment correction mode comes or not, thereby separately from the correction judgment mode, can recognize the periodic incoming of the color misalignment correction mode.

The color image forming apparatus of the embodiments, even if the execution time of the color misalignment correction mode does not come, has the control section for executing the color misalignment correction mode depending on the judgment results of the correction judgment mode, thereby even if the color misalignment correction time does not come, can execute the color misalignment correction mode.

The color image forming apparatus of the embodiments has the control section for calculating the difference between the color misalignment amount of the preceding image and the color misalignment amount of the present image on the basis of the image detection information outputted from the detection section and discriminating whether the difference in the color misalignment amount of the image is included within the set tolerance or not, thereby when the difference in the color misalignment amount of the image is beyond the set tolerance, even if the execution time of the color misalignment correction mode does not come, can execute the concerned color misalignment correction mode.

The color image forming apparatus of the embodiments has the control section, even if the execution time of the color misalignment correction mode comes, depending on the judgment results of the correction judgment mode, for not executing the color misalignment correction mode, thereby as a result of the correction judgment mode, when "No need to execute color misalignment correction mode" is judged, can control the image forming section so as not to execute the color misalignment correction mode at the present time.

The color image forming apparatus of the embodiments has the control section for calculating the difference between the color misalignment amount of the preceding image and the color misalignment amount of the present image on the basis of the image detection information outputted from the detection section and discriminating whether the difference in the color misalignment amount of the image is included within the set tolerance or not, thereby when the difference in the color misalignment amount of the image is within the set tolerance, even if the execution time of the color misalignment correction mode comes, can control the image forming section so as not to execute the concerned color misalignment correction mode.

The color image forming apparatus of the embodiments has the control section, on the basis of the temperature detection information and information of the number of fed sheets of the image forming section, for discriminating whether the execution time of the color misalignment correction mode comes or not, thereby when the temperature of the image forming section is higher or lower than the prescribed value or when the number of sheets fed to the image forming section is larger than the prescribed value, separately from the correction judgment mode, can recognize the periodical incoming of the color misalignment correction mode.

The color image forming apparatus of the embodiments has the control section, on the basis of the comparison results between the temperature detection information and the set temperature information, for discriminating whether the execution time of the color misalignment correction mode comes or not, thereby when the temperature of the image forming section is higher or lower than the prescribed value, separately from the correction judgment mode, can recognize the periodical incoming of the color misalignment correction mode.

The color image forming apparatus of the embodiments has the control section, on the basis of the comparison results between the information of the number of fed sheets and the information of the set number of sheets, for discriminating whether the execution time of the color misalignment correction mode comes or not, thereby when the number of sheets fed to the image forming section is larger than the prescribed value, separately from the correction judgment mode, can recognize the periodical incoming of the color misalignment correction mode.

The color image forming apparatus of the embodiments has the control section, when the execution time of the color misalignment correction mode comes, for setting the next execution time of the color misalignment correction mode based on the judgment results of the correction judgment mode, thereby can correct the preset execution time of the color misalignment correction mode.

The color image forming apparatus of the embodiments, since the control section, on the basis of the comparison results of the color misalignment amount of the image based on the image detection information outputted from the detection section with the set threshold value, calculates the execution time of the color misalignment correction mode, can set newly the next execution time of the color misalignment correction mode.

The color image forming apparatus of the embodiments, since the setting section for setting the execution time of the color misalignment correction mode and the control section rewrites the execution time of the color misalignment correction mode set by the setting section with the calculated execution time of the color misalignment correction mode, thereby can update the execution time of the color misalignment correction mode.

The color image forming apparatus of the embodiments, since the detection section has a plurality of optical sensors, and the optical sensors are arranged on the positions on the image carrier at predetermined intervals and detect images formed in the image boundary area of the image carrier, thereby can obtain images necessary for the statistical process for predicting the execution time of the color misalignment correction mode little by little.

The color image forming apparatus of the embodiments, the control section processes statistically the detection results of the image, predicts the trend of the color misalignment amount of the image, calculate the execution timing of the color misalignment correction mode based on the predicted trend, calculates beforehand the color misalignment correction amount at time of the calculated execution timing of the color misalignment correction mode, and when the calculated execution timing of the color misalignment correction comes, executes the color misalignment correction on the basis of the calculated color misalignment correction amount. Thus, compared with the periodic execution of the color misalignment correction mode, the productivity as well as the image quality can be improved.

The color image forming apparatus of the embodiments, since the control section processes statistically the detection results of the image, predicts the trend of the color misalignment amount of the image, calculates the color misalignment correction amount before the prescribed execution time of the color misalignment correction mode, and on the way to the prescribed execution time of the color misalignment correction mode, executes the color misalignment correction mode based on the color misalignment correction amount, compared with the periodic execution of the color misalignment correction mode, can improve the image quality.

The color image forming apparatus of the embodiments, since the image forming section has a plurality of light sources arranged in line in the main scanning direction of the image carrier and is equipped with a writing unit for exposing image information for the image carrier in a batch in each line, can predict the trend of the color misalignment amount on the basis of the image written in each line.

The color image forming apparatus of the embodiments has a writing unit for exposing image information for each pixel for the image carrier, thereby can predict the trend of the color misalignment amount on the basis of the image written by a light beam deflected and scanned in the main scanning direction.

The present invention is suitably applicable to a tandem system color printer and a color copying machine having photosensitive drums and an intermediate transfer belt for executing a color misalignment correction process on the basis of a color misalignment correction mode and a color MFP thereof.

What is claimed is:

1. A color image forming apparatus comprising:

an image forming section which forms an image based on image information on an image carrier provided in the image forming section;

a detection section which detects a print mark for color misalignment correction formed on the image carrier by the image forming section, and outputs print mark detection information; and a control section for executing color misalignment correction control based on the print mark detection information outputted from the detection section, wherein operations of stopping an image forming process to form an image based on the image information onto the image carrier, executing an image forming process to form a first print mark for color misalignment correction onto the image carrier, detecting the first print mark, and executing the color misalignment correction based on a detection result of the first print mark are assumed to be operations of a color misalignment correction mode, and operations of forming a second print mark for color misalignment correction onto an image boundary area of the image carrier, detecting the second print mark, and judging whether or not to execute the color misalignment correction mode based on a result of the second print mark detection, are assumed to be operations of a correction judgment mode, wherein the image boundary area, is an area on the image carrier between an image area of a page and an image area of the next page, images of both the pages being formed on the image carrier based on the image information, wherein, in the correction judgment mode, the control section obtains a trend of a color misalignment amount of the second print mark by statistically processing data of the result of the second print mark detection, calculates an execution timing of color misalignment correction based on the obtained trend, and executes the color misalignment correction mode at the calculated execution timing.

2. The color image forming apparatus of claim 1, in the correction judgment mode, the control section compares the obtained trend of the color misalignment amount of the second print mark with a prescribed threshold value, calculates a timing when a color misalignment amount in the trend reaches the threshold value, and determines the timing as the execution timing of the color misalignment correction mode.

3. The color image forming apparatus of claim 1, in the correction judgment mode, the control section executes an averaging processing and an interpolating processing of the data of the result of the second print mark detection to obtain the trend of the color misalignment amount.

4. The color image forming apparatus of claim 1, wherein a either one of a main scanning dedicated print mark which enables an analysis of the color misalignment amount in a main scanning direction, a sub scanning dedicated print mark which enables analysis of the color misalignment amount in a sub scanning direction, or a composite print mark combining the main scanning dedicated print mark and the sub scanning dedicated print mark is selectable as a print mark for color misalignment correction, and the image forming section forms a preliminary selected print mark for color misalignment correction on the image carrier, where a width direction of the image carrier is assumed as the main scanning direction and a direction perpendicular to the main scanning direction is assumed as the sub scanning direction.

5. The color image forming apparatus of claim 1, wherein the detection section has a plurality of optical sensors and the optical sensors are arranged at positions over the image carrier at predetermined intervals and detect images formed in the image boundary area of the image carrier.

6. The color image forming apparatus of claim 1, wherein the image forming section has a writing unit for exposing the image information in batch with a unit of each line with respect to the image carrier, the writing unit comprising a plurality of light sources arranged in line along the main scanning direction of the image carrier.

7. The color image forming apparatus of claim 1, wherein the image forming section has a writing unit for exposing the image information for each pixel with respect to the image carrier, the writing unit comprising a light source for deflecting and scanning a light beam in the main scanning direction of the image carrier.

8. A color image forming apparatus comprising:

an image forming section which forms an image based on image information on an image carrier provided in the image forming section;

a detection section which detects a print mark for color misalignment correction formed on the image carrier by the image forming section, and outputs print mark detection information; and a control section for executing color misalignment correction control based on the print mark detection information outputted from the detection section, wherein operations of forming a print mark for color misalignment correction onto an image boundary area of the image carrier, detecting the print mark, and judging whether or not to execute the color misalignment correction based a result of the print mark detection, are assumed to be operations of a correction judgment mode, wherein the image boundary area, is an area on the image carrier between an image area of a page and an image area of the next page, images of both the pages being formed on the image carrier based on the image information, wherein, in the correction judgment mode, the control section obtains a trend of a color misalignment amount of the second print mark by statistically processing data of the result of the print mark detection, calculates an execution timing of color misalignment correction and a color misalignment correction amount base on the obtained trend, and executes the color misalignment correction based on the calculated execution timing and the calculated color misalignment correction amount.

9. The color image forming apparatus of claim 8, in the correction judgment mode, the control section compares the obtained trend of the color misalignment amount of the print mark with a prescribed threshold value, calculates a timing when a color misalignment amount in the trend reaches the threshold value, and determines the timing as the execution timing of the color misalignment correction.

10. The color image forming apparatus of claim 8, in the correction judgment mode, the control section executes an averaging processing and an interpolating processing of the data of the result of the print mark detection to obtain the trend of the color misalignment amount.

11. An image forming method comprising:

forming an image based on image information on an image carrier;

detecting a print mark for color misalignment correction formed on the image carrier, and outputting print mark detection information;

obtaining, in a correction judgment mode, a trend of a color misalignment amount of the second print mark by statistically processing data of the result of the second print mark detection, and calculating an execution timing of color misalignment correction base on the obtained trend; and executing a color misalignment correction mode at the calculated execution timing, wherein operations of stopping an image forming process to form an image based on the image information onto the image carrier, executing an image forming process to form a first print mark for color misalignment correction onto the image carrier, detecting the first print mark, and executing the color misalignment correction based on a detection result of the first print mark are assumed to be operations of the color misalignment correction mode, and operations of forming a second print mark for color misalignment correction onto an image boundary area of the image carrier, detecting the second print mark, and judging whether or not to execute the color misalignment correction mode based a result of the second print mark detection, are assumed to be operations of the correction judgment mode, wherein the image boundary area, is an area on the image carrier between an image area of a page and an image area of the next page, images of both the pages being formed on the image carrier based on the image information.

12. The image forming method of claim 11, in the correction judgment mode, further comprising:

comparing the obtained trend of the color misalignment amount of the second print mark with a prescribed threshold value, calculating a timing when a statistically processed color misalignment amount in the trend reaches the threshold value, and determining the timing as the execution timing of the color misalignment correction mode.

13. The color image forming apparatus of claim 11, in the correction judgment mode, further comprising:

executing an averaging processing and an interpolating processing of the data of the result of the second print mark detection to obtain the trend of the color misalignment amount.

14. An image forming method comprising:

forming an image based on image information on an image carrier;

detecting a print mark for color misalignment correction formed on the image carrier, and outputting print mark detection information;

obtaining, in a correction judgment mode, a trend of a color misalignment amount of the second print mark by statistically processing data of the result of the print mark detection, and calculating an execution timing of color misalignment correction and a color misalignment correction amount base on the obtained trend; and executing the color misalignment correction based on the calculated execution timing and the calculated color misalignment correction amount, wherein operations of forming a print mark for color misalignment correction onto an image boundary area of the image carrier, detecting the print mark, and judging whether or not to execute the color misalignment correction based on a result of the print mark detection, are assumed to be operations of the correction judgment mode, wherein the image boundary area, is an area on the image carrier between an image area of a page and an image area of the next page, images of both the pages being formed on the image carrier based on the image information.

15. The image forming method of claim 14, in the correction judgment mode, further comprising:

comparing the obtained trend of the color misalignment amount of the print mark with a prescribed threshold value, calculating a timing when a color misalignment amount in the trend reaches the threshold value, and determining the timing as the execution timing of the color misalignment correction mode.

16. The image forming method of claim 14, in the correction judgment mode, further comprising:

executing an averaging processing and an interpolating processing of the data of the result of the print mark detection to obtain the trend of the color misalignment amount.

* * * * *